US011091317B2

(12) United States Patent
Polacek et al.

(10) Patent No.: US 11,091,317 B2
(45) **Date of Patent: *Aug. 17, 2021**

(54) VERTICAL FLUID STORAGE TANK WITH CONNECTING PORTS

(71) Applicant: JWF Industries, Johnstown, PA (US)

(72) Inventors: William C. Polacek, Johnstown, PA (US); Marc J. Speciale, Johnstown, PA (US); Matthew J. Hughes, Davidsville, PA (US)

(73) Assignee: JWF Industries, Inc., Johnstown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/010,028

(22) Filed: Jun. 15, 2018

(65) Prior Publication Data

US 2018/0290826 A1 Oct. 11, 2018

Related U.S. Application Data

(63) Continuation-in-part of application No. 14/703,272, filed on May 4, 2015, now Pat. No. 10,202,236.

(Continued)

(51) Int. Cl.

*B65D 88/02* (2006.01)
*B65D 88/12* (2006.01)

(Continued)

(52) U.S. Cl.

CPC ..... *B65D 88/027* (2013.01); *B65D 88/128* (2013.01); *B65D 88/748* (2013.01);

(Continued)

(58) Field of Classification Search

CPC ..... B65D 88/027; B65D 88/08; B65D 88/12; B65D 88/128–129; B65D 90/0033;

(Continued)

(56) References Cited

U.S. PATENT DOCUMENTS 1,232,929 A * 7/1917 Keller ..... B65D 88/02 220/565
1,602,506 A * 10/1926 Rowland ..... F16L 41/10 137/454.2

(Continued)

FOREIGN PATENT DOCUMENTS

DE 202007005707 U1 8/2007

OTHER PUBLICATIONS

Photo and Product Sheet of Redneck Oilfield Rentals 400 bbl Tank, http://www.redneckoilfield.ca/tanks.html, 2 pages.

(Continued)

*Primary Examiner* — Chun Hoi Cheung
*Assistant Examiner* — Brijesh V. Patel
(74) *Attorney, Agent, or Firm* — The Webb Law Firm

(57) ABSTRACT

A vertical fluid storage tank includes an oval-shaped body having a first end, a second end, and a sidewall extending between the first and second ends. The body defines an interior fluid storage cavity and has a major axis and a minor axis along a horizontal cross section through the body. The fluid storage tank further includes a top wall at the first end of the body, a bottom wall at the second end of the body, and a frame member connected to the sidewall of the body. The frame member includes a first portion that extends longitudinally along the sidewall of the body and a second portion that extends along the bottom wall and is connected to the first portion. The fluid storage tank further includes a connection port on the sidewall of the body adapted for connection to the connection port on an adjacent fluid storage tank.

20 Claims, 18 Drawing Sheets

Related U.S. Application Data

(60) Provisional application No. 61/989,236, filed on May 6, 2014.

(51) Int. Cl.
*B65D 88/74* (2006.01)
*B65D 90/00* (2006.01)
*B65D 90/02* (2019.01)
*B65D 90/16* (2006.01)

(52) U.S. Cl.
CPC ..... *B65D 90/0006* (2013.01); *B65D 90/024* (2013.01); *B65D 90/16* (2013.01); *B65D 2590/0091* (2013.01)

(58) Field of Classification Search
CPC ..... B65D 90/24; B65D 2590/0091; F17C 2201/035; F17C 2223/0153
USPC ..... 220/1.5, 560.03, 562, 565, 571; 137/1, 137/382, 395–396, 590; 222/103, 221, 222/235, 413, 459; 280/414.5, 830, 837, 280/839
See application file for complete search history.

(56) References Cited

U.S. PATENT DOCUMENTS 2,078,939 A * 5/1937 Ferguson ..... B60P 3/222 280/838
2,146,960 A * 2/1939 Kuss ..... B60P 3/22 280/832
2,163,387 A * 6/1939 Thwaits ..... B60P 3/221 220/653
2,189,945 A * 2/1940 Fitch ..... B60P 3/2205 220/562
2,208,621 A * 7/1940 Ball ..... B60K 15/03 220/562
2,271,660 A * 2/1942 Norbom ..... B65D 88/128 220/562
D138,245 S * 7/1944 Bradley ..... D12/95
2,354,425 A * 7/1944 Kuhn ..... B65D 7/045 220/661
D162,118 S 2/1951 Bausenbach
2,563,470 A * 8/1951 Kane ..... B65D 88/30 280/830
2,609,964 A * 9/1952 Cadwell ..... F17C 13/002 220/724
2,673,010 A * 3/1954 Barrow ..... B65D 7/045 222/182
2,920,784 A 1/1960 Boardman
2,943,752 A * 7/1960 Platt ..... B65D 88/28 414/323
3,160,171 A 12/1964 Klein
D201,477 S 6/1965 Mowatt-Larssen et al.
3,255,927 A * 6/1966 Ruppert, Jr. ..... B65D 90/20 222/143
3,339,499 A 9/1967 Charles et al.
3,570,705 A 3/1971 Yazdani
3,583,331 A 6/1971 Mowatt-Larssen
3,605,830 A * 9/1971 Haskins ..... B65G 65/365 141/284
3,618,801 A * 11/1971 Blanchard ..... B60P 3/00 414/483
3,638,699 A 2/1972 Hillinger
3,675,670 A * 7/1972 Ogawa ..... B67D 7/78 137/1
3,680,275 A 8/1972 Romlet et al.
3,687,319 A * 8/1972 Adam ..... B60P 1/483 414/482
3,712,250 A * 1/1973 Geyer ..... B61D 5/06 105/360
3,792,790 A * 2/1974 Brubaker ..... B65D 88/30 414/332
3,834,576 A 9/1974 Heisterberg
3,883,148 A * 5/1975 Miller ..... B65D 88/26 280/837
3,906,995 A * 9/1975 Schmidt ..... B65D 88/027 137/575
4,002,192 A * 1/1977 Mowatt-Larssen ..... B65D 88/022 141/35
D243,455 S 2/1977 Verini
4,079,760 A * 3/1978 Hurst ..... B61D 5/02 137/575
4,100,610 A 7/1978 Johnston et al.
4,318,549 A 3/1982 Pletcher
4,348,962 A 9/1982 Smith
4,374,478 A 2/1983 Secord et al.
4,406,471 A 9/1983 Holloway
4,474,254 A 10/1984 Etter et al.
D278,457 S * 4/1985 Schroder ..... B61D 7/02 D23/205
D279,921 S 7/1985 Blumer et al.
4,589,565 A 5/1986 Spivey
4,615,453 A 10/1986 Taquoi
4,644,871 A * 2/1987 Arrey ..... B61D 7/02 105/248
4,655,367 A 4/1987 Palazzo
4,696,238 A 9/1987 Billingsley, Jr. et al.
D301,326 S 5/1989 Adams
4,838,703 A 6/1989 McMaster et al.
4,855,960 A * 8/1989 Janssen ..... B01F 7/00708 366/8
4,932,551 A * 6/1990 Thomas ..... B65D 77/0466 220/1.5
4,939,833 A 7/1990 Thomas
4,960,222 A 10/1990 Fields, III
5,055,204 A 10/1991 Bogart
5,073,259 A * 12/1991 Solimar ..... B65G 53/60 210/232
5,082,416 A 1/1992 Bock
5,083,673 A 1/1992 Fossey
5,096,007 A 3/1992 Burkhard
5,129,540 A 7/1992 Palazzo
5,156,268 A * 10/1992 Nichols ..... B65D 77/0466 206/386
5,188,252 A 2/1993 Gerhard
RE34,203 E 3/1993 Palazzo
5,198,398 A 3/1993 van Duijn
5,273,180 A 12/1993 Whatley, Jr.
5,330,070 A * 7/1994 Gerhard ..... B65D 88/128 220/562
D353,352 S 12/1994 Holloway, Jr.
5,390,806 A 2/1995 Elston et al.
D375,470 S 11/1996 Adams
D378,810 S 4/1997 Norman, Jr. et al.
5,647,514 A 7/1997 Toth et al.
5,671,855 A 9/1997 Norman, Jr. et al.
D384,913 S 10/1997 Norman, Jr. et al.
5,695,089 A 12/1997 Reese et al.
5,779,077 A 7/1998 Fossey
5,787,920 A 8/1998 Krasnov
5,804,716 A * 9/1998 McGuire ..... B60P 3/22 280/832
D412,962 S 8/1999 Riley
5,931,335 A * 8/1999 Cippitani ..... B60P 3/222 280/838
5,960,826 A 10/1999 Hebblethwaite et al.
D417,171 S 11/1999 Satterfield et al.
5,996,827 A 12/1999 Splane
6,079,580 A 6/2000 Garton et al.
6,199,910 B1 3/2001 Wade
D441,692 S 5/2001 Niblett et al.
6,237,505 B1 * 5/2001 Sande ..... B61D 7/02 105/247
6,273,647 B1 * 8/2001 Vande Sande ..... B61D 7/32 105/248
6,279,955 B1 8/2001 Fisher
6,318,581 B1 11/2001 Garton
6,375,222 B1 4/2002 Wade
6,390,325 B1 5/2002 Gonzales

(56) References Cited

U.S. PATENT DOCUMENTS 6,464,094 B2 10/2002 Zacharias
6,564,961 B1 * 5/2003 Klein ..... B60P 3/2235 137/574
6,726,409 B1 4/2004 Yielding et al.
7,059,575 B2 * 6/2006 Garton ..... B65D 90/12 108/55.5
7,104,425 B2 9/2006 Le Roy
RE39,721 E 7/2007 Garton
7,252,429 B2 8/2007 Yungblut
D557,178 S 12/2007 Petzitillo, Jr. et al.
7,475,910 B1 * 1/2009 Calonge ..... B60P 3/2235 280/830
7,758,076 B1 * 7/2010 DiGiacomo ..... B65D 77/0466 220/1.5
D637,114 S 5/2011 Ries
7,997,623 B2 8/2011 Williams
D653,587 S 2/2012 Haut et al.
8,215,516 B2 7/2012 Kaupp
8,231,316 B2 * 7/2012 Ness ..... B65D 88/022 410/46
8,366,312 B1 2/2013 Valdez et al.
8,590,720 B2 11/2013 Thomas, II
8,833,582 B1 * 9/2014 Ellis ..... B65D 88/027 220/23.4
D728,731 S * 5/2015 Ellis ..... B65G 1/02 D23/202
9,169,067 B2 * 10/2015 Raney ..... B65G 1/02
2002/0166861 A1 11/2002 Hinkle et al.
2003/0020253 A1 * 1/2003 Albert Bosman .... B60P 3/2235 280/830
2006/0096991 A1 5/2006 Schmidt et al.
2007/0056975 A1 3/2007 Long et al.
2007/0084808 A1 * 4/2007 Williamson ..... B01D 21/0012 210/806
2008/0087665 A1 4/2008 Rummel
2009/0134171 A1 5/2009 deBerardinis
2009/0223975 A1 * 9/2009 McCallister ..... B65D 77/0466 206/386
2010/0032435 A1 2/2010 Satterfield et al.
2010/0071284 A1 * 3/2010 Hagan ..... E21B 41/00 52/192
2010/0122988 A1 5/2010 Clanton
2010/0320727 A1 12/2010 Haut et al.
2011/0006068 A1 1/2011 Kaupp
2011/0042384 A1 * 2/2011 Pfau ..... B65D 88/128 220/565
2011/0061855 A1 * 3/2011 Case ..... E21B 21/062 166/113
2011/0109073 A1 5/2011 Williams
2011/0121555 A1 5/2011 Anderson
2011/0186581 A1 8/2011 Ries
2011/0211818 A1 9/2011 Grady
2012/0024738 A1 * 2/2012 Herman ..... B60P 3/40 414/483
2012/0073675 A1 * 3/2012 Dupuis ..... B08B 9/0933 137/238
2012/0134772 A1 5/2012 Herman et al.
2012/0199508 A1 8/2012 Hebblethwaite
2013/0193150 A1 * 8/2013 Keefer ..... B65D 39/084 220/562
2013/0284751 A1 10/2013 Rund
2014/0096832 A1 4/2014 Thiessen
2014/0130914 A1 * 5/2014 Mertens ..... B60P 3/2205 220/562
2014/0169920 A1 * 6/2014 Herman ..... B60P 3/40 414/483
2015/0059858 A1 3/2015 Ellis
2015/0321834 A1 11/2015 Hughes et al.
2016/0347539 A1 * 12/2016 Diaz Carrillo ..... B65D 88/08

OTHER PUBLICATIONS

Photo of Wrangler Rentals Tank, 1 page.
Photos and Product Sheet of Crown Tank Infinity Tank, http://dev.crowntank.com/wp-content/uploads/2014/01/infinity.pdf, 2 pages.
Photo and Product Sheets of Pro-Find Equipment, Inc. 400 bbl Single Wall Tank, http://www.profindequipmentinc.com/Tank-details2.html, Feb. 16, 2012, 6 pages.
Product Sheet of TNT Energy Services, Ltd. 400 bbl Upright Tank, http://tntenergy.ca/400-bbl-uprights/, Oct. 14, 2011, 1 page.
Product Sheet of Wylie Oilfield Rentals 400 bbl Production Tank, http://allisonchampagne.com/wylie/wp-content/uploads/2013/09/400-Bbl-Production-Tank.pdf, Sep. 26, 2011, 1 page.
Product Sheet of Wylie Oilfield Rentals 400 bbl Heated and Insulated Production Tank, http://allisonchampagne.com/wylie/wp-content/uploads/2013/09/400-Bbl-Heated-Insulated-Production-Tank.pdf, Dec. 3, 2012, 1 page.
Photo and Product Sheet of Revcon 400 bbl Storage Tank, http://revcon.ca/what-we-do/rentals/400bbl-tanks, Jan. 15, 2011, 5 pages.
Photos and Product Sheet of Advanced Fluid Containment, LLC 400 bbl Round Skidded Tank, http://afctanks.com/products/skidded-tanks.html, Apr. 2, 2012, 6 pages.
Photos and Product Sheet of Strad 400 bbl Tank, http://www.stradenergy.com/Our-Solutions/Surface-Equipment/8/400-BBL-Tanks, Aug. 18, 2012, 2 pages.

* cited by examiner

VERTICAL FLUID STORAGE TANK WITH CONNECTING PORTS

CROSS REFERENCE TO RELATED APPLICATION

This application is a continuation-in-part application of U.S. application Ser. No. 14,703,272, entitled "Portable Vertical Fluid Storage Tank" and filed May 4, 2015, which claims the benefit of U.S. Provisional Patent Application No. 61/989,236, filed May 6, 2014, the disclosures of all of which are hereby incorporated by reference in their entirety.

BACKGROUND OF THE INVENTION

Field of the Invention

This disclosure relates generally to fluid storage tanks and, more particularly, to vertical fluid storage tanks. This disclosure additionally relates to arrays of interconnected fluid storage tanks.

Description of Related Art

Portable fluid storage tanks used to store well fracturing fluids are well known in the art. Current pre-existing storage tanks include trailer tanks and skidded tanks. The trailer tanks are sized, shaped, and oriented similar to the tank of a semi-tractor trailer and include a rear axle with wheels for transportation. These trailer tanks are typically transported to a worksite via a semi-tractor trailer and parked together with additional trailer tanks for storage of the worksite's fracturing fluids. The fracturing fluid is pumped from the trailer tanks and is used for the fracturing of the worksite. After the trailer tank has been depleted, the trailer tank is transported from the worksite back to a filling station to refill the tank. These trailer tanks are typically positioned in a horizontal direction relative to the ground of the worksite. One example of such a trailer tank is shown in U.S. Pat. No. 8,215,516 to Kaupp.

The pre-existing skid tanks are generally cylindrical with skids welded to a side surface of the tank. The skid tanks are transported to the worksite in a similar manner as trailer tanks. The skid tanks are loaded onto a trailer of a semi-tractor trailer and transported to the worksite. Upon delivering the skid tanks to the worksite, the skid tank is lifted into a vertical position using chains or cables pulled by winches or a suitable vehicle. The semi-tractor trailer may also include a mechanism for tipping the skid tank off of the trailer and into a vertical position. The pre-existing fluid storage tanks each have advantages and disadvantages for use at worksites. Trailer tanks typically have a low profile but require a large storage space area at the worksite due to the horizontal length of each trailer tank. Skid tanks typically require less room for storage at the worksite, but require additional handling and care for placing each skid tank in a vertical position. Further, extra equipment is usually needed to put the skid tank in a vertical position.

When fracturing a gas well in a shale formation, for example, a very large amount of fracturing fluid is necessary for performing the operation. Due to economic considerations, the well is typically fractured in a single, uninterrupted procedure. Equipment rental costs and labor costs are often increased if the fracturing procedure needs to be terminated due to a lack of fracturing fluid. Therefore, it is often necessary to ensure that the proper amount of fracturing fluid is provided at the worksite before starting the fracturing procedure. In situations where a lengthy and long fracture is necessary, a large volume of fracturing fluid is required. This in turn necessitates the use of a large number of fluid storage tanks to hold the requisite amount of fracturing fluid. It is therefore desirable to house the largest amount of fracturing fluid in the smallest area of worksite space possible.

SUMMARY OF THE INVENTION

In view of the foregoing, there exists a need for a fluid storage tank that occupies a small amount of area while providing a large amount of fracturing fluid. Further, there exists a need for a fluid storage tank that is easily transported to the worksite and easily arranged at the worksite. Still further, there exists a need for fluid storage tanks that are connectable with one another to increase the total volume of fluid available.

It is therefore an object of this invention to provide a fluid storage tank that has a small footprint to provide a maximum amount of fluid storage at a worksite. It is a further object of the invention to provide a fluid storage tank that is connectable with other fluid storage tanks in an array to increase the total volume of fluid available for a worksite operation.

Aspects of the present disclosure are directed to a vertical fluid storage tank including an oval-shaped body having a first end and a second end and a sidewall extending between the first end and the second end, the oval-shaped body defining an interior fluid storage cavity, and the oval-shaped body having a major axis and a minor axis along a horizontal cross-section through the oval-shaped body. The vertical fluid storage tank further includes a top wall at the first end of the body; a bottom wall at the second end of the body; a frame member connected to the sidewall of the oval-shaped body, the frame member including a first portion that extends longitudinally along the sidewall of the oval-shaped body and a second portion that extends along the bottom wall and is connected to the first portion; and a connection port on the sidewall of the oval-shaped body adapted for connection to the connection port on an adjacent vertical fluid storage tank of identical configuration.

In some aspects, an outermost width of the second portion is less than an outermost width of the bottom wall of the oval-shaped body.

In some aspects, the first portion of the frame member further includes a ladder extending in a longitudinal direction relative to the oval-shaped body.

In some aspects, the vertical fluid storage tank further includes a walkway extending across the top wall.

In some aspects, the frame member is substantially L-shaped with the first portion extending along the longitudinal length of the oval-shaped body and the second portion extending along the bottom wall.

In some aspects, the vertical fluid storage tank further includes at least one stiffening ring positioned in the interior fluid storage cavity of the oval-shaped body.

In some aspects, the vertical fluid storage tank further includes at least one tension member positioned in the interior fluid storage cavity of the oval-shaped body.

In some aspects, the vertical fluid storage tank further includes at least one compression member positioned in the interior fluid storage cavity of the oval-shaped body.

In some aspects, the connection port is located on the sidewall of the oval-shaped body so as to be aligned with the minor axis.

In some aspects, the vertical fluid storage tank further includes a pair of connection ports located on opposite sides of the oval-shaped body, each of the connection ports aligned with the minor axis.

Other aspects of the present disclosure are directed to an array of vertical fluid storage tanks, including a plurality of the vertical fluid storage tanks located side-by-side to one another. Each of the vertical fluid storage tanks includes an oval-shaped body having a first end and a second end and a sidewall extending between the first end and the second end, the oval-shaped body defining an interior fluid storage cavity, and the oval-shaped body having a major axis and a minor axis along a horizontal cross section through the oval-shaped body; a top wall at the first end of the body; a bottom wall at the second end of the body; a frame member connected to the sidewall of the oval-shaped body, the frame member including a first portion that extends longitudinally along the sidewall of the oval-shaped body and a second portion that extends along the bottom wall and is connected to the first portion; and a connection port on the sidewall of the oval-shaped body adapted for connection to the connection port of an adjacent vertical fluid storage tank of identical configuration. In the array, each of the adjacent vertical fluid storage tanks is arranged such that the major axes of the respective vertical fluid storage tanks are generally parallel to one another.

In some aspects, an outermost width of the second portion of the frame member of at least one of the vertical fluid storage tank is less than an outermost width of the bottom wall of the oval-shaped body.

In some aspects, the first portion of the frame member of at least one of the vertical fluid storage tanks further comprises a ladder extending in a longitudinal direction relative to the oval-shaped body.

In some aspects, at least one of the vertical fluid storage tanks further comprises a walkway extending across the top wall.

In some aspects, the frame member of each vertical fluid storage tank is substantially L-shaped with the first portion extending along the longitudinal length of the oval-shaped body and the second portion extending along the bottom wall.

In some aspects, at least one of the vertical fluid storage tanks further comprises at least one stiffening ring positioned in the interior fluid storage cavity of the oval-shaped body.

In some aspects, at least one of the vertical fluid storage tanks further comprises at least one tension member positioned in the interior fluid storage cavity of the oval-shaped body.

In some aspects, at least one of the vertical fluid storage tanks further comprises at least one compression member positioned in the interior fluid storage cavity of the oval-shaped body.

In some aspects, the connection port on each of the vertical fluid storage tanks is located on the sidewall of the oval-shaped body so as to be aligned with the minor axis.

In some aspects, each vertical fluid storage tank further comprises a pair of connection ports located on opposite sides of the oval-shaped body, and wherein each of the connection ports is aligned with the minor axis of the respective vertical fluid storage tanks.

These and other features and characteristics of vertical fluid storage tanks will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

DESCRIPTION OF THE PREFERRED EMBODIMENTS

For purposes of the description hereinafter, spatial orientation terms, as used, shall relate to the referenced aspect as it is oriented in the accompanying drawings, figures, or otherwise described in the following detailed description. However, it is to be understood that the aspects described hereinafter may assume many alternative variations and configurations. It is also to be understood that the specific components, devices, features, and operational sequences illustrated in the accompanying drawings, figures, or otherwise described herein are simply exemplary and should not be considered as limiting.

Referring to FIGS. 1-7, a fluid storage tank 2 includes a body 4 extending from a first end 5*a* to a second end 5*b*. The first end 5*a* may include a top wall 6 connected to the body 4. The second end 5*b* may include a bottom wall 8 connected to the body 4. The body 4 may be constructed as one monolithic structure or as several different pieces. In one aspect, the top wall 6 may be constructed from two different panels. The top wall 6 may extend straight across the first end 5*a* of the body 4. Alternatively, the two different panels may be angled relative to one another so that the top wall 6 may be sloped from a middle portion of the top wall 6 down to an outer circumferential edge of the top wall 6. The body 4 may be made from a metallic material, such as steel or aluminum. It is also contemplated that the body 4 may be made from different metallic materials, including additional materials that have a high water corrosion resistance. It is also to be understood that the body 4 may be made from a hard plastic-like material.

Figure 1:
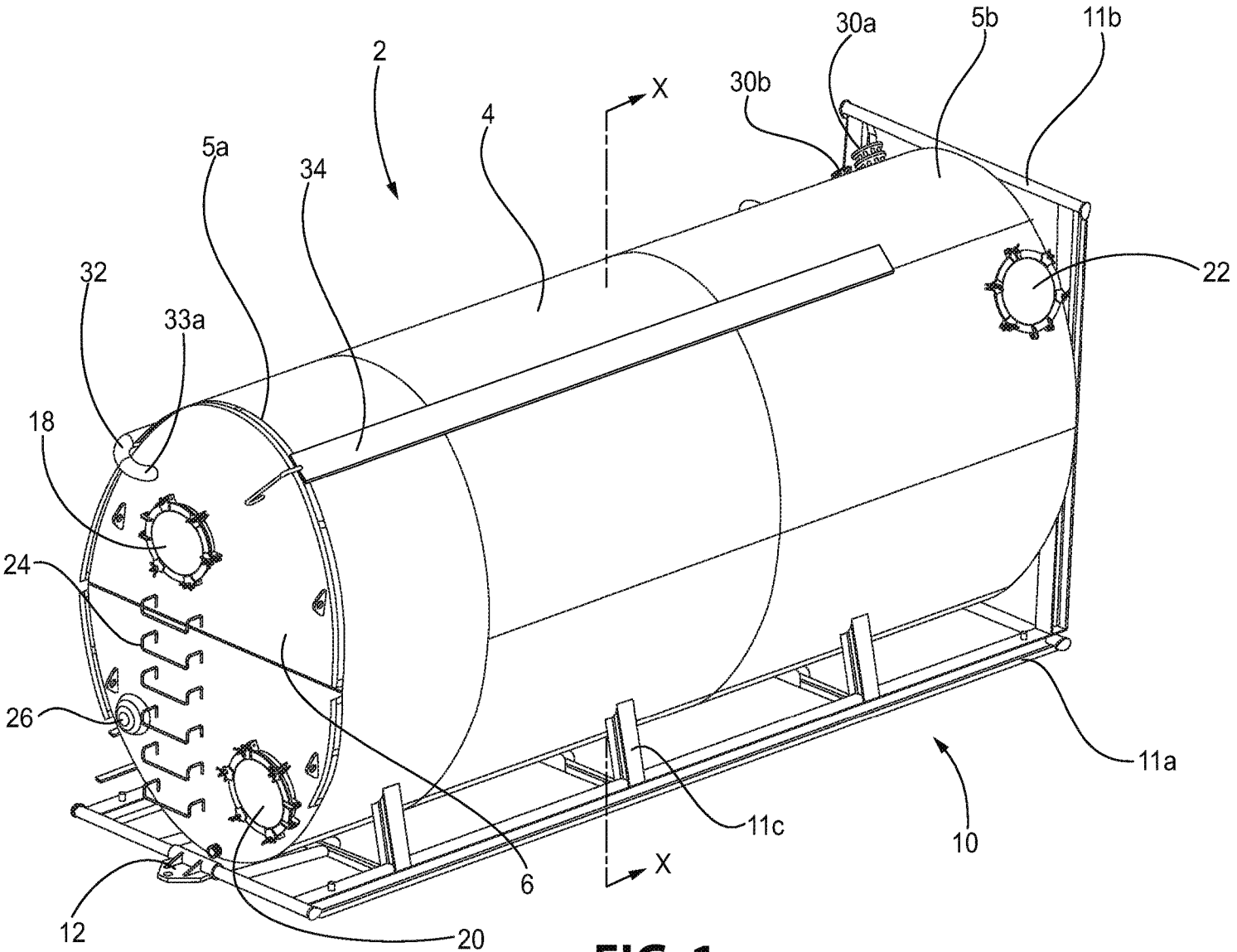
FIG. 1 is a front perspective view of a fluid storage tank in accordance with this disclosure.
Figure 7:
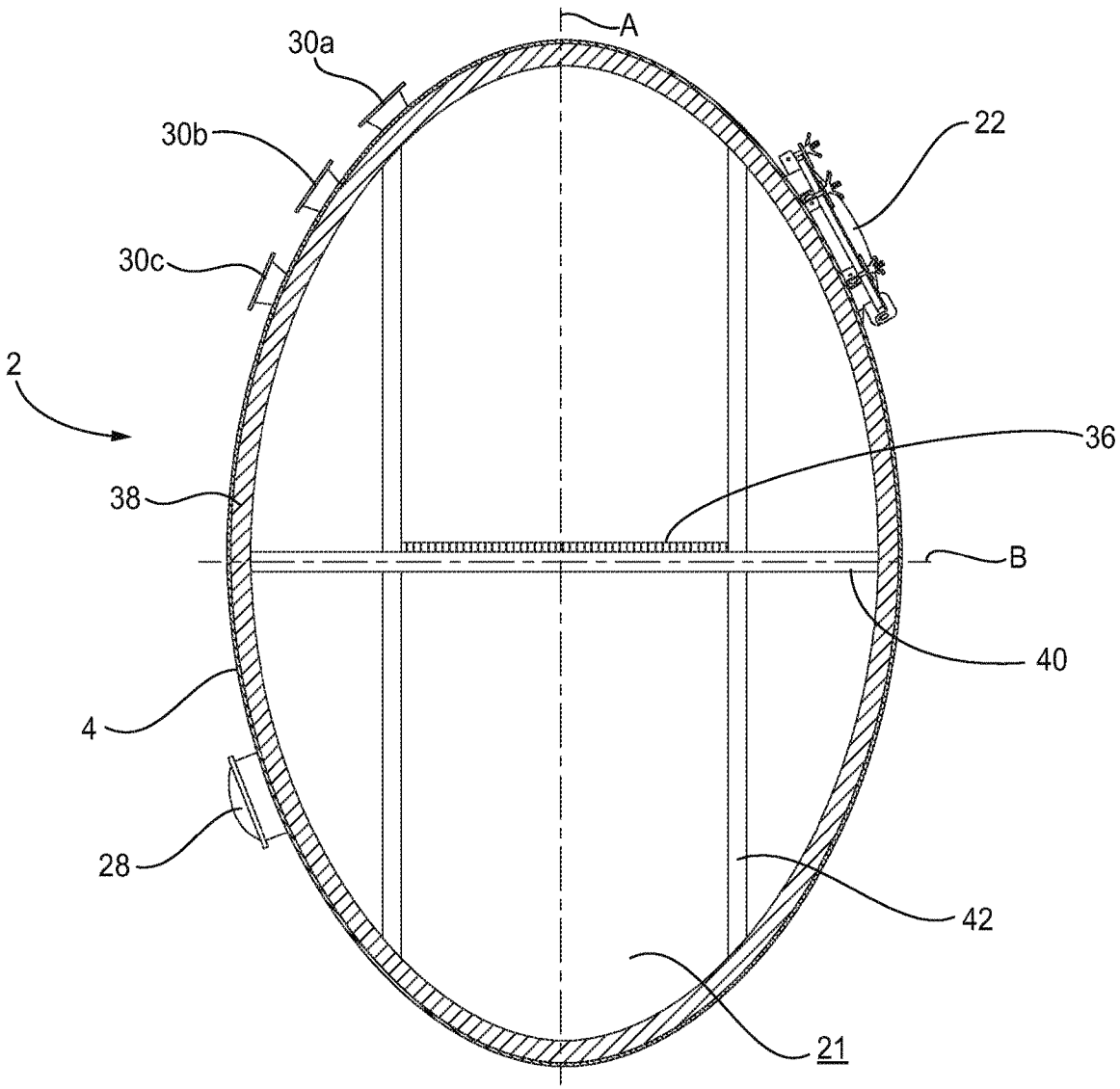
FIG. 7 is a cross-sectional view of the fluid storage tank of FIG. 1 along line X-X.
Figure 9:
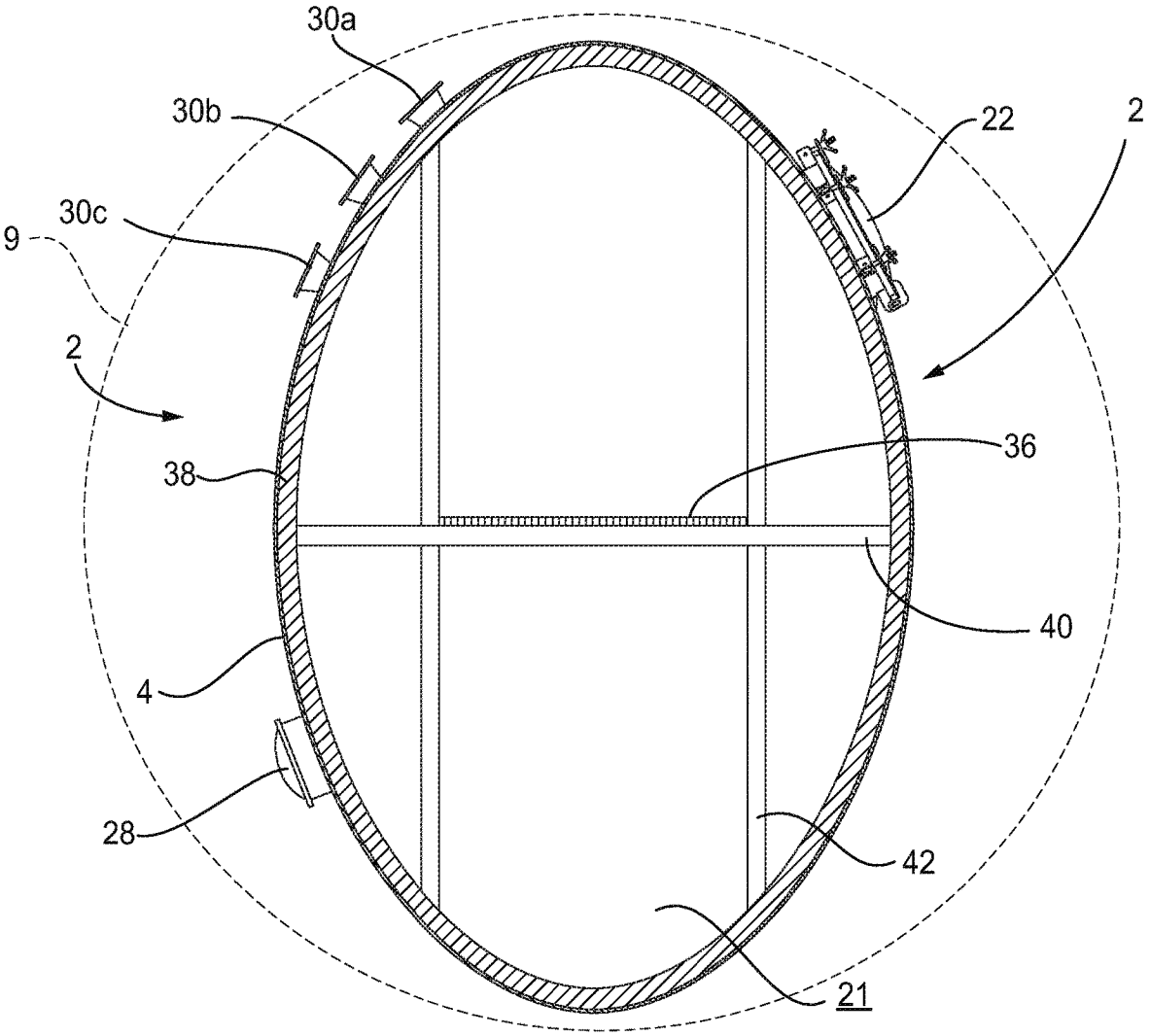
FIG. 9 is a bottom view of the fluid storage tank of FIG. 1 depicting the footprint of the fluid storage tank compared to a pre-existing fluid storage tank.
Figure 10:
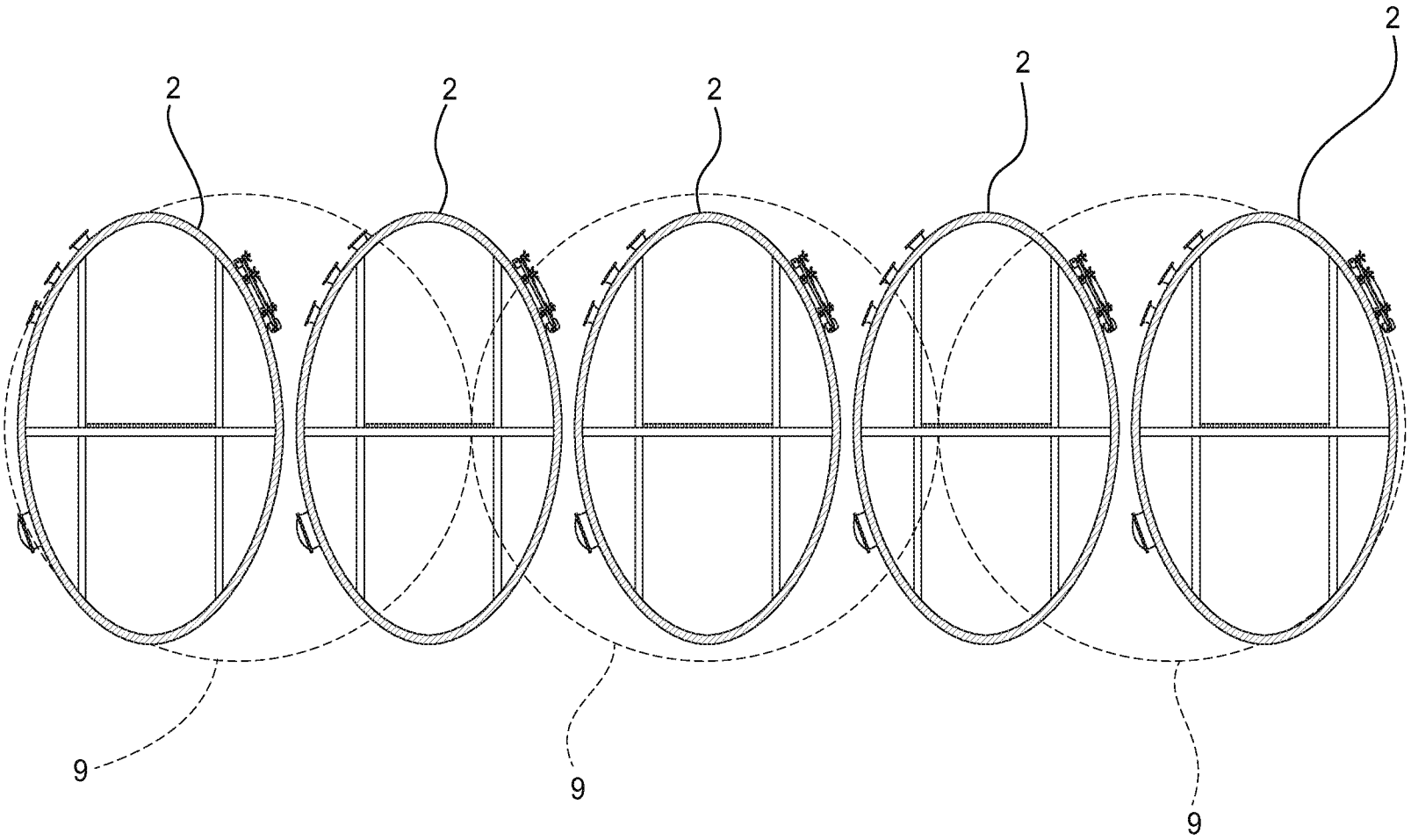
FIG. 10 is a bottom view showing several fluid storage tanks like that of FIG. 1 in comparison to several pre-existing fluid storage tanks.
Figure 11:
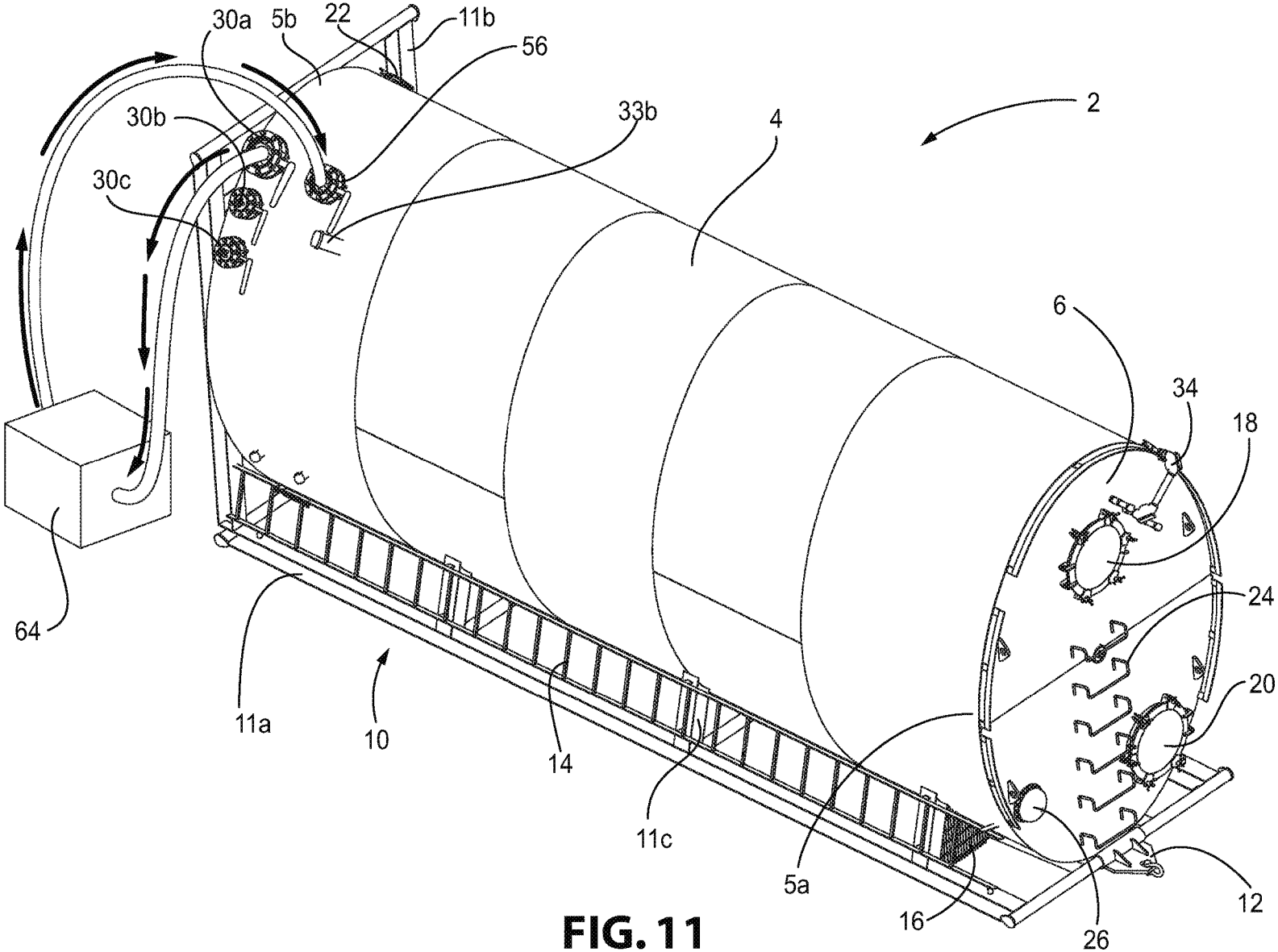
FIG. 11 is a front perspective view of a fluid storage tank in accordance with another aspect of the disclosure.
Figure 12:
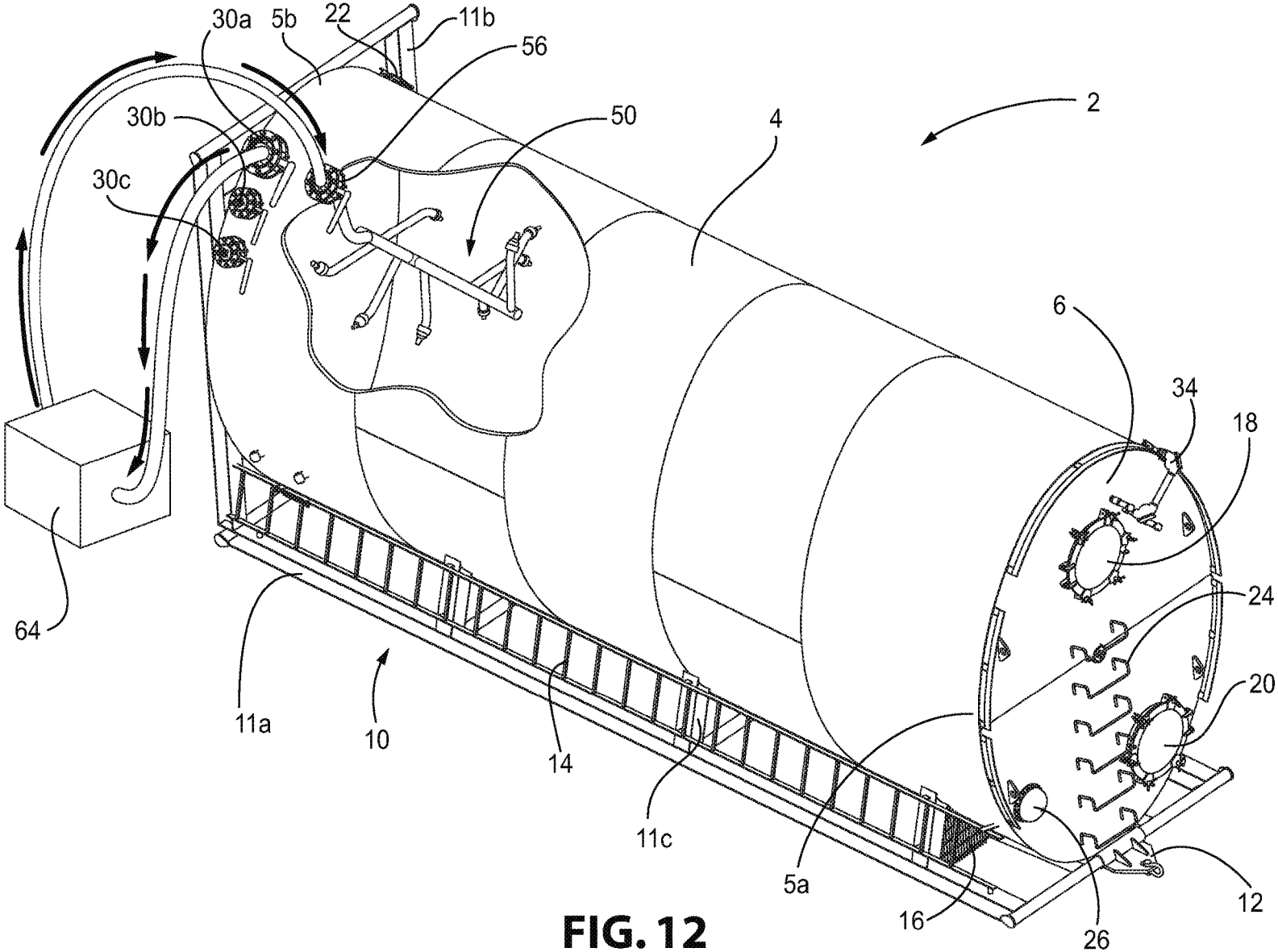
FIG. 12 is a front perspective view of the fluid storage tank of FIG. 11 with a portion of the fluid storage tank removed to show a fluid circulating arrangement housed therein.

The body 4 has a substantially oval cross-sectional shape. Specifically, a horizontal cross section of the body 4, as shown in FIG. 7, has a length defined by a major axis A and a width defined by a minor axis B perpendicular to the major axis A. The centroid of the oval cross section of the body 4 is coincident with the intersection of the major axis A and a minor axis B. By using an oval shape for the cross section of the body 4, the footprint or amount of space occupied by an end 5*a*, 5*b* of the body 4 is greatly reduced. As shown in FIGS. 9 and 10, the footprint of the oval-shaped body 4 is substantially smaller than the footprint of current circular fluid storage tanks 9. Although the cross-sectional area of the fluid storage tank 2 is smaller than the cross-sectional area of current fluid storage tanks 9, the same volume of fluid may still be stored within the fluid storage tank 2. By increasing the overall longitudinal length of the fluid storage tank 2, the same volume of fluid can be stored within the fluid storage tank 2. It is often an important feature of fluid storage tanks to have a small footprint so as to allow a maximum number of fluid storage tanks to be arranged at a worksite. By using a smaller overall footprint with the fluid storage tank 2, a greater number of fluid storage tanks 2 can be stored at a worksite, as shown in FIG. 10. In one aspect, the fluid storage tank 2 may be arranged in a first position in which the fluid storage tank 2 is arranged horizontal to a surface, such as the ground of a worksite. An example of this first position is shown in FIG. 1. The fluid storage tank 2 may also be arranged in a second position in which the fluid storage tank 2 is arranged vertical to the surface or ground of the worksite. The fluid storage tank 2 may be positioned in this second position by using winches and cables or chains to pull the fluid storage tank 2 into a vertical position. Alternatively, a crane or similar vehicle (not shown) may be used to arrange the fluid storage tank 2 in the vertical position. It is to be understood that additional methods of arranging the fluid storage tank 2 in a vertical position are contemplated, such as through the use of a pneumatic-cylinder system used with a tractor trailer.

With continuing reference to FIGS. 1-7, a frame member 10 may be connected to the body 4 of the fluid storage tank 2. In one aspect, the frame member 10 may be L-shaped including a first portion 11*a* and a second portion 11*b*. The first portion 11*a* may extend longitudinally along the body 4 and may include support members 11*e* that may be connected to the body 4. The number of support members 11*e* may be adjusted according to the size and volume of the fluid storage tank 2. The second portion 11*b* may be connected to the second end 5*b* of the body 4 and one end of the first portion 11*a* of the frame member 10. The frame member 10 provides support to the body 4 when the fluid storage tank 2 is arranged in either the first horizontal position or the second vertical position. When the fluid storage tank 2 is arranged in the first horizontal position, the first portion 11*a* may provide support to the body 4. Likewise, when the fluid storage tank 2 is arranged in the second vertical position, the second portion 11*b* may provide support to the body 4. The frame member 10 may be constructed from several pieces of tubing, or may be formed as one monolithic structure. The frame member 10 may also include a coupling mechanism 12 positioned on the first portion 11*a* near the first end 5*a* of the body 4. The coupling mechanism 12 may be used to attach the fluid storage tank 2 to the hitch of a vehicle for transportation to and from a worksite. The coupling mechanism 12 may also be used to anchor the fluid storage tank 2 to the ground or structure when not in use.

In order to minimize the footprint of the fluid storage tank 2 and to permit multiple fluid storage tanks 2 to be arranged side-by-side as closely as possible, an outermost width of the first portion 11*a* and the second portion 11*b* of the frame member 10 may be less than an outermost width of the bottom wall 8 of the body 4. Particularly, the outermost width of the second portion 11*b* of the frame member 10 along the minor axis B (see FIG. 7) is less than the outermost width of the bottom wall 8 along the minor axis B.

Figure 2:
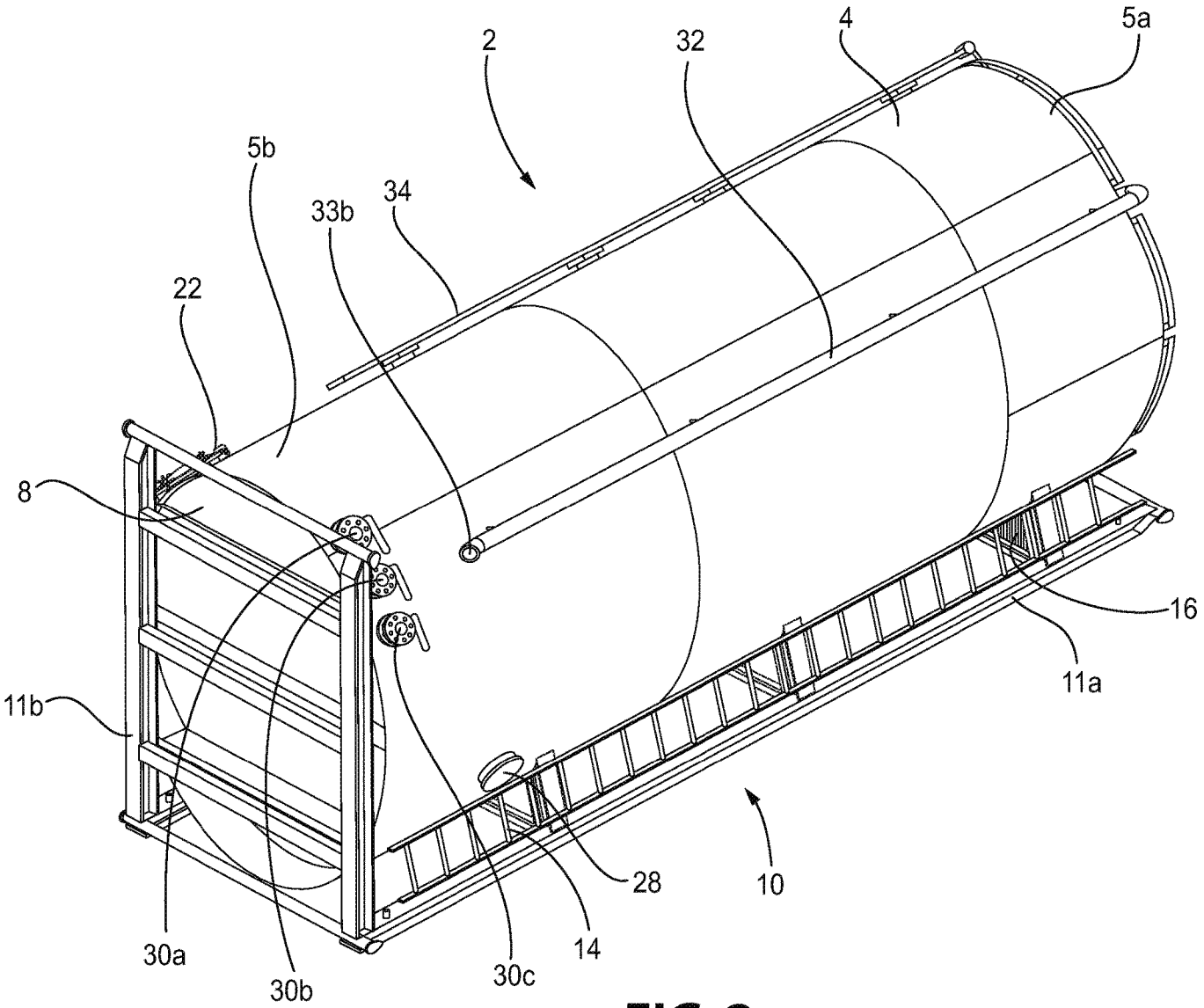
FIG. 2 is a rear perspective view of the fluid storage tank of FIG. 1.
Figure 3:
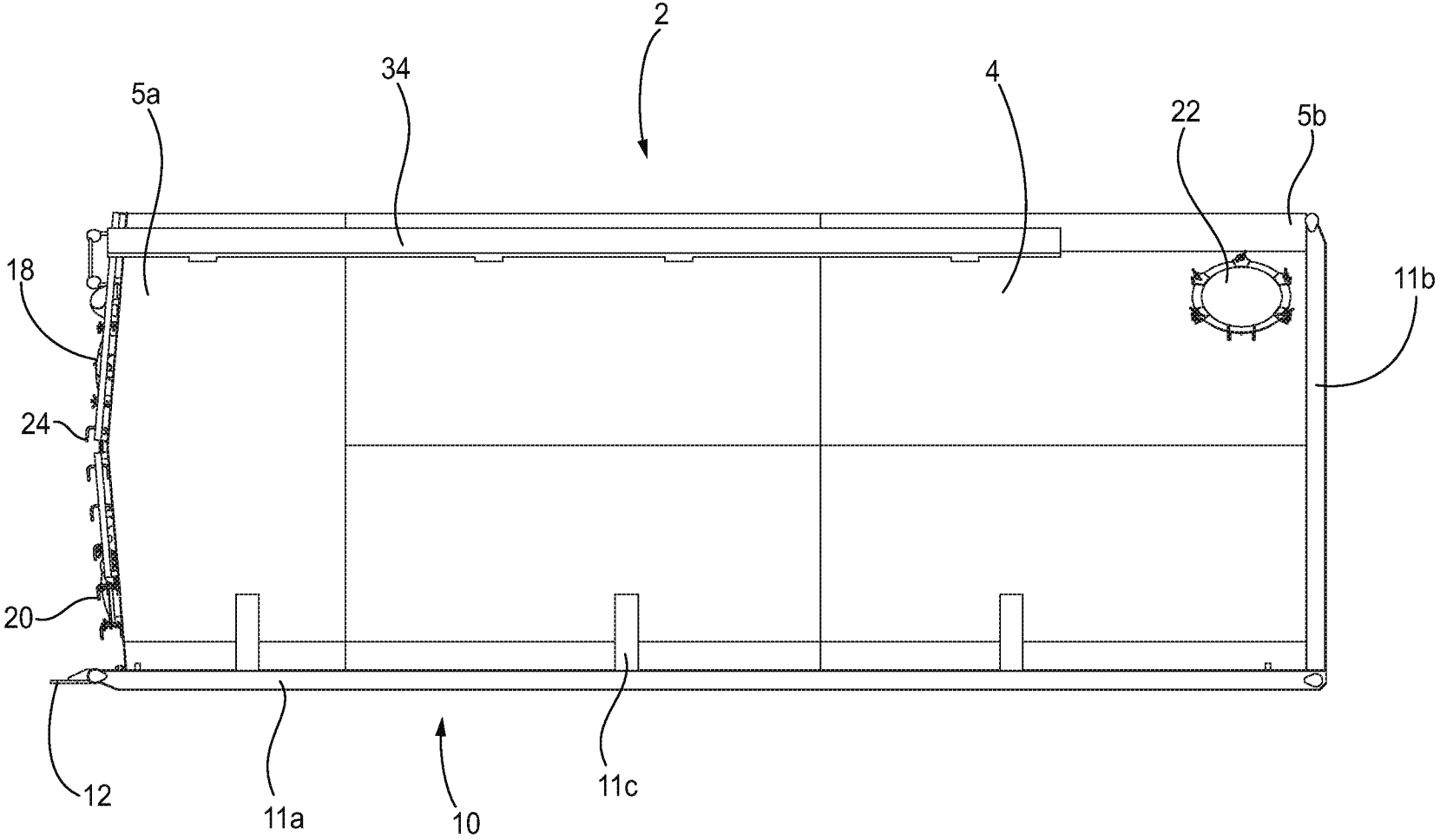
FIG. 3 is a side view of the fluid storage tank of FIG. 1.
Figure 4:
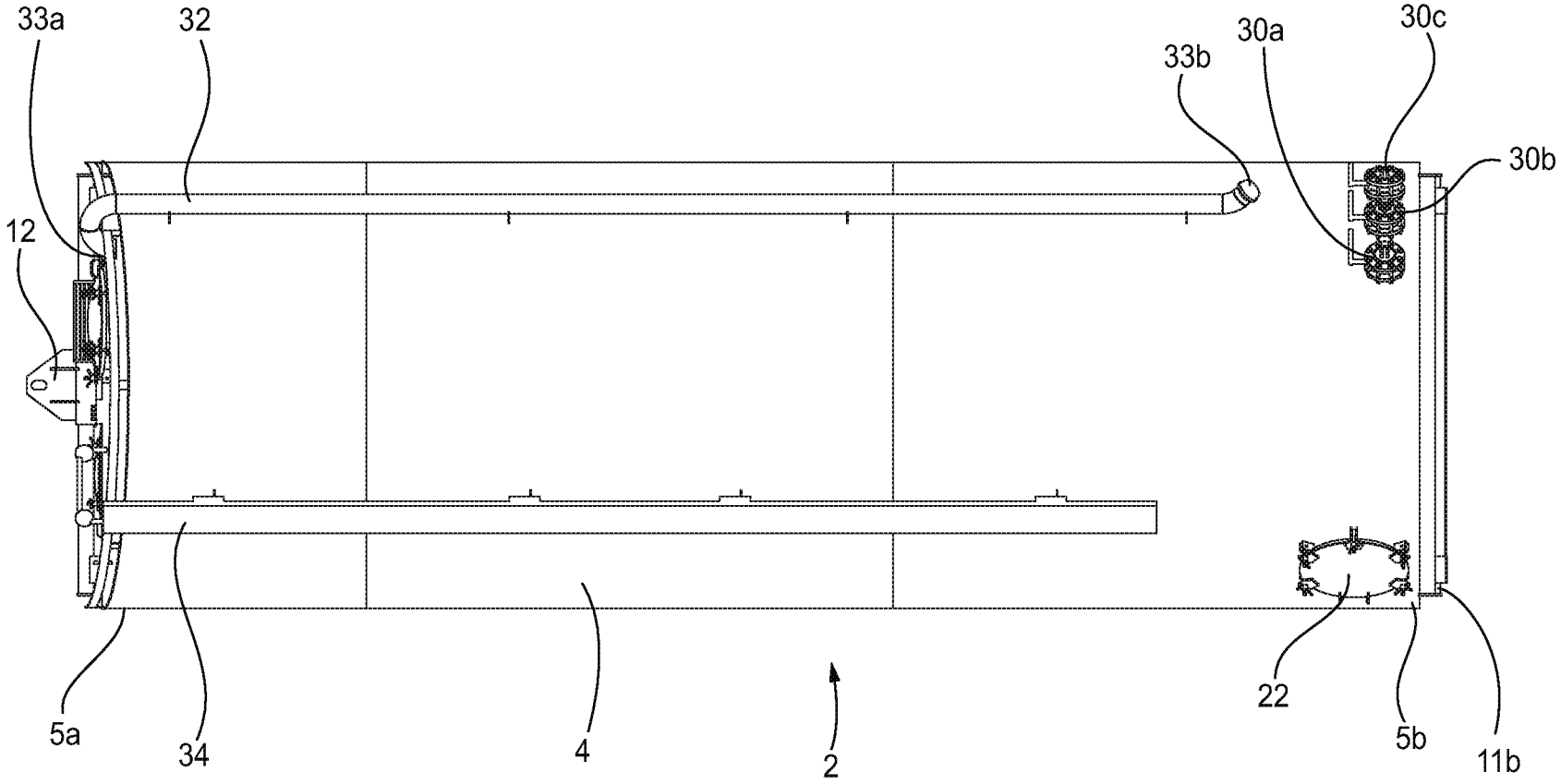
FIG. 4 is front view of the fluid storage tank of FIG. 1.
Figure 6:
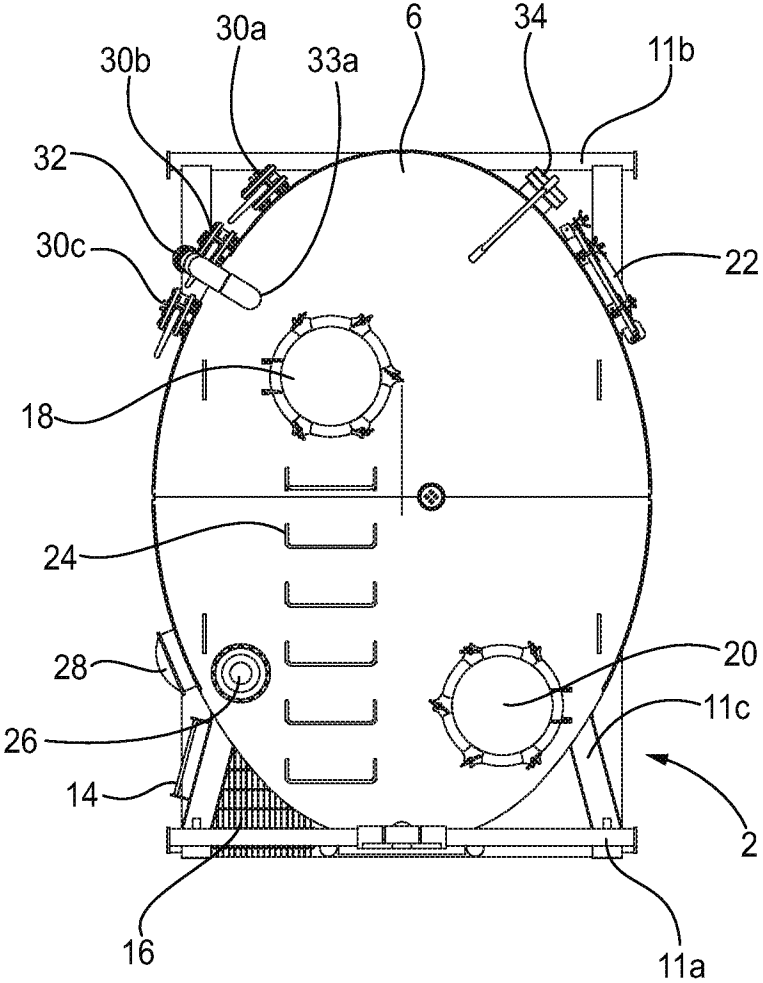
FIG. 6 is a top view of the fluid storage tank of FIG. 1.
Figure 5:
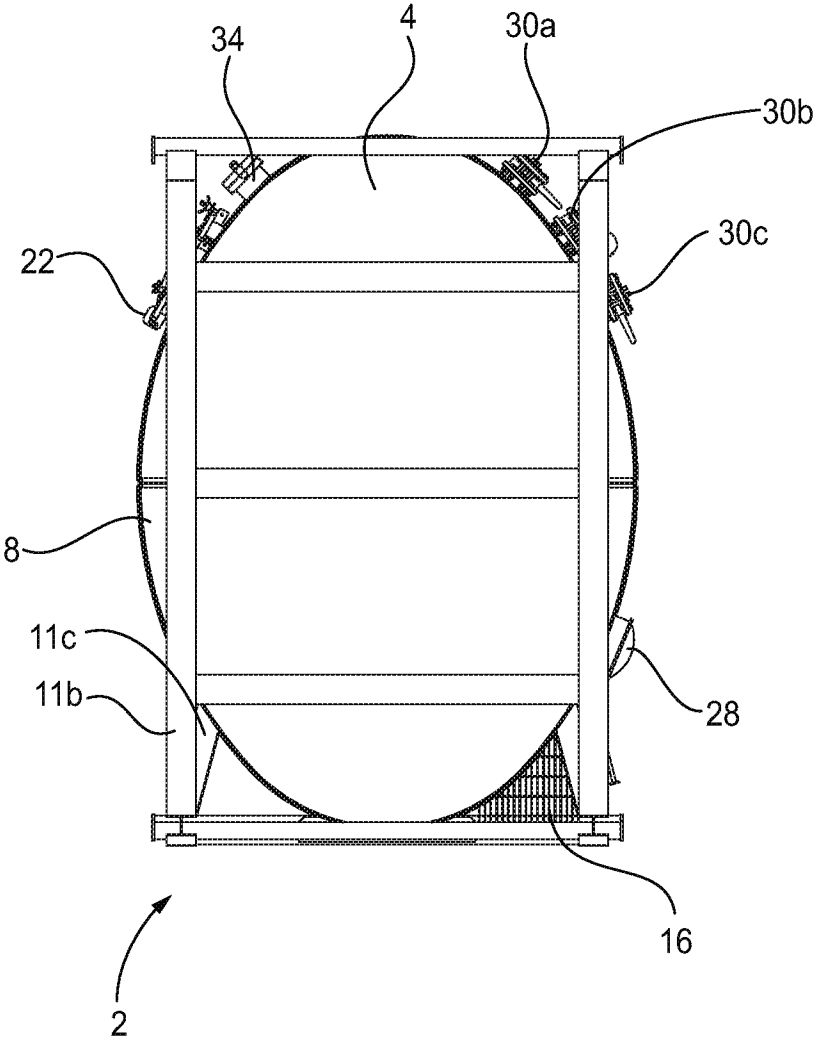
FIG. 5 is a bottom view of the fluid storage tank of FIG. 1.

As shown in FIG. 2, the frame member 10 may also include a ladder 14 and a walkway 16 located on the first portion 11*a* of the frame member 10. The ladder 14 may be attached to the frame member 10 using any well-known fastening arrangement, including welding, fasteners, or forming the ladder 14 as an integral part of the frame member 10. The ladder 14 extends in a longitudinal direction along the body 4 of the fluid storage tank 2 and extends from one end of the first portion 11*a* of the frame member 10 to a second end of the first portion 11*a* of the frame member 10. The walkway 16 may be positioned perpendicular to the ladder 14 and near the first end 5*a* of the body 4. The walkway 16 may extend across the top wall 6 of the fluid storage tank 2. When arranged in the second vertical position, the ladder 14 of the frame member 10 may be used by an individual to climb to the top of the fluid storage tank 2 and stand on the walkway 16. The individual can access an interior cavity 21 of the body 4 by standing on the walkway 16, as will be described in further detail below.

As shown in FIG. 1, the fluid storage tank 2 may also include several access openings 18, 20, 22 that allow an individual to access the interior cavity 21 of the fluid storage tank 2. In one aspect, these access openings 18, 20, 22 are configured as hatches on an exterior surface of the body 4. The access openings 18, 20, 22 may be hingedly attached to the body 4 or may be attached using removable fasteners that can be removed and attached by an individual to open and close the access openings 18, 20, 22. At least two access openings 18, 20 may be positioned on the top wall 6 of the body 4. One access opening 18 may be positioned on an upper portion of the top wall 6, and another access opening 20 may be positioned on a lower portion of the top wall 6. In one aspect, the access openings 18, 20 are positioned opposing one another. Another access opening 22 may be positioned near the second end 5*b* of the body 4. This access opening 22 is positioned on an exterior surface of the body 4 and allows for an individual to access the interior cavity 21 of the body 4. When the fluid storage tank 2 is positioned in the second vertical position, an individual may access the interior cavity 21 of the body 4 via the access opening 22. An individual may access the interior cavity 21 of the body 4 to clean the fluid storage tank 2 or inspect the internal components of the fluid storage tank 2 for stress fractures or wear.

In one aspect, another ladder 24 may be positioned on the top wall 6 of the fluid storage tank 2. The ladder 24 may be fastened to, welded to, or formed integral with the top wall 6. When the fluid storage tank 2 is arranged in the first horizontal position, the ladder 24 allows for an individual to climb up the surface of the top wall 6 and open/close the access opening 18. When in the first horizontal position, the ladder 24 extends from a bottom portion of the top wall 6 to a bottom portion of the access opening 18. A hatch opening 26 may be positioned on the top wall 6 of the fluid storage tank 2. In one aspect, the hatch opening 26 may be positioned adjacent to the ladder 24. The hatch opening 26 may be what is commonly known as a "thief" hatch, which is configured to provide pressure and vacuum relief within the fluid storage tank 2. As shown in FIG. 2, a ventilation opening 28 may be positioned on the second end 5*b* of the body 4 of the fluid storage tank 2. The ventilation opening 28 is configured to provide extra ventilation when drying and/or cleaning the interior of the fluid storage tank 2.

As shown in FIGS. 1, 2, and 4-6, a plurality of discharge valves 30*a*, 30*b*, 30*c* may be positioned on the exterior of the body 4 and may be in fluid communication with the interior cavity 21 of the body 4. The discharge valves 30*a*, 30*b*, 30*c* may be positioned near the second end 5*b* of the body 4. In one aspect, the discharge valves 30*a*, 30*b*, 30*c* may be butterfly-type valves. It is also contemplated that fewer or more discharge valves may be provided on the body 4. It is also contemplated that the discharge valves 30*a*, 30*b*, 30*c* may be provided at different locations on the body 4. The discharge valves 30*a*, 30*b*, 30*c* are configured to be connected to hoses or similar devices used to move the fluid stored in the fluid storage tank 2 to a desired location, such as a fracture well, when arranged in the second vertical position.

As shown in FIG. 2, an inlet pipe 32 may also be connected to the body 4 of the fluid storage tank 2. In one aspect, the inlet pipe 32 may be provided on an exterior surface of the body 4. In another aspect, the inlet pipe 32 may be provided in the interior cavity 21 of the body 4. The inlet pipe 32 may include a first end 33*a* connected to the top wall 6 of the body 4 and a second end 33*b* positioned near the second end 5*b* of the body 4. The first end 33*a* of the inlet pipe 32 may be in fluid communication with the interior cavity 21 of the body 4. The inlet pipe 32 is commonly known as a "downcomer". The inlet pipe 32 may be used to fill the fluid storage tank 2 with fluid via the second end 33*b* of the inlet pipe 32. Fluid communication between an outside fluid source (not shown) and the second end 33*b* of the inlet pipe 32 may be established to fill the fluid storage tank 2. A level indicator 34 may also be positioned on the body 4 of the fluid storage tank 2. The level indicator 34 includes a portion that is connected to an exterior surface of the body 4 and a portion that extends down into the interior cavity 21 of the body 4. Based on the fluid level in the fluid storage tank 2 when arranged in the second vertical position, the level indicator 34 displays the volume of fluid currently stored in the fluid storage tank 2. The first portion of the level indicator 34 positioned on the exterior surface of the body 4 will display the amount of fluid currently housed in the fluid storage tank 2.

Figure 8:
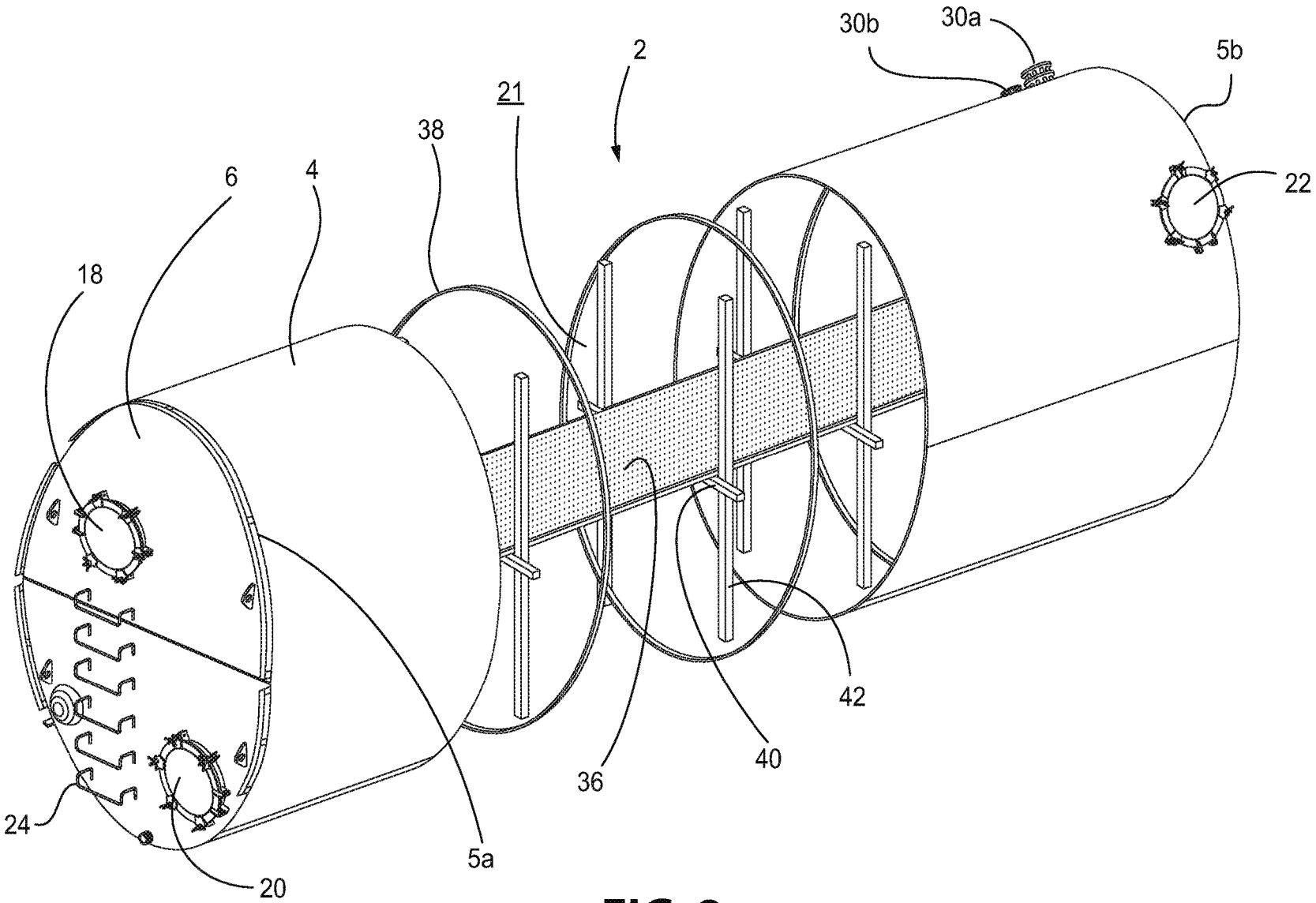
FIG. 8 is a front perspective view of the fluid storage tank of FIG. 1 with a portion of the body of the fluid storage tank removed to show the interior cavity of the fluid storage tank.

With reference to FIGS. 7 and 8, the interior cavity 21 of the body 4 includes several components used to provide added strength and support to the body 4. A walkway 36 may be positioned in the interior cavity 21 of the body 4 and may extend from the first end 5*a* of the body 4 to the second end 5*b* of the body 4. In one aspect, the walkway 36 may be positioned in a substantially centered position within the interior cavity 21 of the body 4. An individual may gain access to the walkway 36 when the fluid storage tank 2 is positioned in the first horizontal position. By entering the interior cavity 21 of the body 4 via the access opening 18, an individual may move along the walkway 36 to inspect the interior cavity 21 of the body 4 and the fluid that is held within the fluid storage tank 2. A top surface of the walkway 36 may be covered with a slip-resistant material so as to assist an individual in walking along the walkway 36, which can often be wet and slippery due to the fluid stored in the fluid storage tank 2. The walkway 36 may be supported by several cross members provided in the interior cavity 21 of the body 4.

With continuing reference to FIGS. 7 and 8, the interior cavity 21 of the body 4 may include several support members used to add stability to the body 4 of the fluid storage tank 2. A plurality of stiffening rings 38 may be positioned along the longitudinal length of the body 4. The stiffening rings 38 form a shape that substantially corresponds to the cross-sectional shape of the body 4. In one aspect, the shape of the stiffening rings 38 may be an oval shape. The stiffening rings 38 may be connected to an interior circumferential surface of the body 4 and provide support to the body 4 when the fluid storage tank 2 is arranged in the first horizontal position. Due to the weight of the fluid stored within, the body 4 may experience a large outward bulging due to the force of the fluid pushing out on the body 4. The stiffening rings 38 may assist in counteracting the large forces created by the stored fluid that is pushing outward on the body 4. The stiffening rings 38 may assist in preventing deformation of the body 4 when fluid is stored therein. It is also contemplated that the stiffening rings 38 may not be included in the body 4 of the fluid storage tank 2. The fluid storage tank 2 may be provided with the requisite strength to withstand the forces described above without the assistance of the stiffening rings 38.

A plurality of tension members 40 may be positioned within the interior cavity 21 of the body 4 to provide added support to the body 4 when the fluid storage tank 2 is filled with fluid. When the fluid storage tank 2 is arranged in the second vertical position, the tension members 40 extend from one side of the body 4 to an opposing second side of the body 4 and are positioned in a parallel plane to the longitudinal axis of the body 4. The tension members 40 may be evenly spaced along the longitudinal length of the body 4 or may be provided in groups according to the specific areas of the body 4 that experience the greatest amount of forces. The tension members 40 may be attached to an inner surface of the body 4. The tension members 40 are configured to counteract the outward forces exerted by the fluid on the body 4 of the fluid storage tank 2. The walkway 36 may be attached to or rest on the tension members 40 in the interior cavity 21 of the body 4. It is also contemplated that the tension members 40 may not be included in the body 4 of the fluid storage tank 2. The fluid storage tank 2 may be provided with the requisite strength to withstand the forces described above without the assistance of the tension members 40.

A plurality of compression members 42 may also be positioned in the interior cavity 21 of the body 4. When the fluid storage tank 2 is arranged in the first horizontal position, the compression members 42 extend from a top portion of the body 4 to an opposing bottom portion of the body 4 and are positioned perpendicular to the longitudinal axis of the body 4. The compression members 42 may be provided evenly along the longitudinal length of the body 4 or may be provided in groups according to the specific areas of the body 4 that experience the greatest amount of forces. The compression members 42 may be attached to an inner surface of the body 4. The compression members 42 are configured to counteract inward forces exerted by the body 4 resting on the ground or worksite surface. In one aspect, the tension members 40 and the compression members 42 may be stiff, rigid beams that are configured to withstand large amounts of pressure. In one aspect, the tension members 40 and the compression members 42 may be comprised of steel or any similar metallic material that is resistant to rusting. It is also contemplated that the compression members 42 may not be included in the body 4 of the fluid storage tank 2. The fluid storage tank 2 may be provided with the requisite strength to withstand the forces described above without the assistance of the compression members 42.

Referring again to FIGS. 9 and 10, the footprint of the fluid storage tank 2 is substantially smaller than the footprint created by current circular fluid storage tanks 9. As shown in FIGS. 9 and 10, several more fluid storage tanks 2 may be positioned in a certain pre-defined area as compared to the number of current circular fluid storage tanks 9 that include a circular cross-sectional shape. By reducing the footprint of the fluid storage tank 2, more fluid storage tanks 2 may be used at worksites, which allows for more fluid to be supplied to the worksite project.

With reference to FIGS. 11-15, the storage tank 2 may optionally not include spacer rings 38, tension members 40, compression members 42, and/or a walkway 36 within the interior cavity 21 of the body 4. In this and other aspects having internal structural components in the interior cavity 21, a fluid circulating arrangement 50 may additionally or alternatively be provided in the interior cavity 21 to create a swirling effect within the fluid stored in the fluid storage tank 2. The components of the fluid circulating arrangement 50 (described below) may be made from hollow piping that permits the flow of fluid therethrough so the fluid circulating arrangement 50 may induce a swirling effect in the fluid storage tank 2. The fluid circulating arrangement 50 may be suspended within the fluid stored in the fluid storage tank 2 or the fluid circulating arrangement 50 may rest on the bottom wall 8 of the fluid storage tank 2. The fluid circulating arrangement 50 may include an inlet member 52 with an inlet attachment 54 provided on one end thereof. The inlet attachment 54 may be fluid connected to an inlet valve 56 provided on the body 4 of the fluid storage tank 2. An opposing end of the inlet member 52 may be fluidly connected to a main supply member 58. The main supply member 58 may extend perpendicular to the inlet member 52. A plurality of discharge members 60 may be fluidly connected to the main supply member 58. The discharge members 60 may extend perpendicular to the main supply member 58. In one aspect, only one discharge member 60 may be provided on the main supply member 58. In another aspect, at least two discharge members 60 may be provided on the main supply member 58. In a further aspect, seven discharge members 60 may be provided on the main supply member 58. A nozzle 62 may be provided on the end of each discharge member 60 that is opposite from the end of the discharge member 60 that is fluidly connected to the main supply member 58. The discharge members 60 may be positioned along the longitudinal length of the main supply member 58. The discharge members 60 may be evenly spaced apart from one another. Alternatively, the discharge members 60 may be positioned in groups along the longitudinal length of the main supply member 58.

Figure 13:
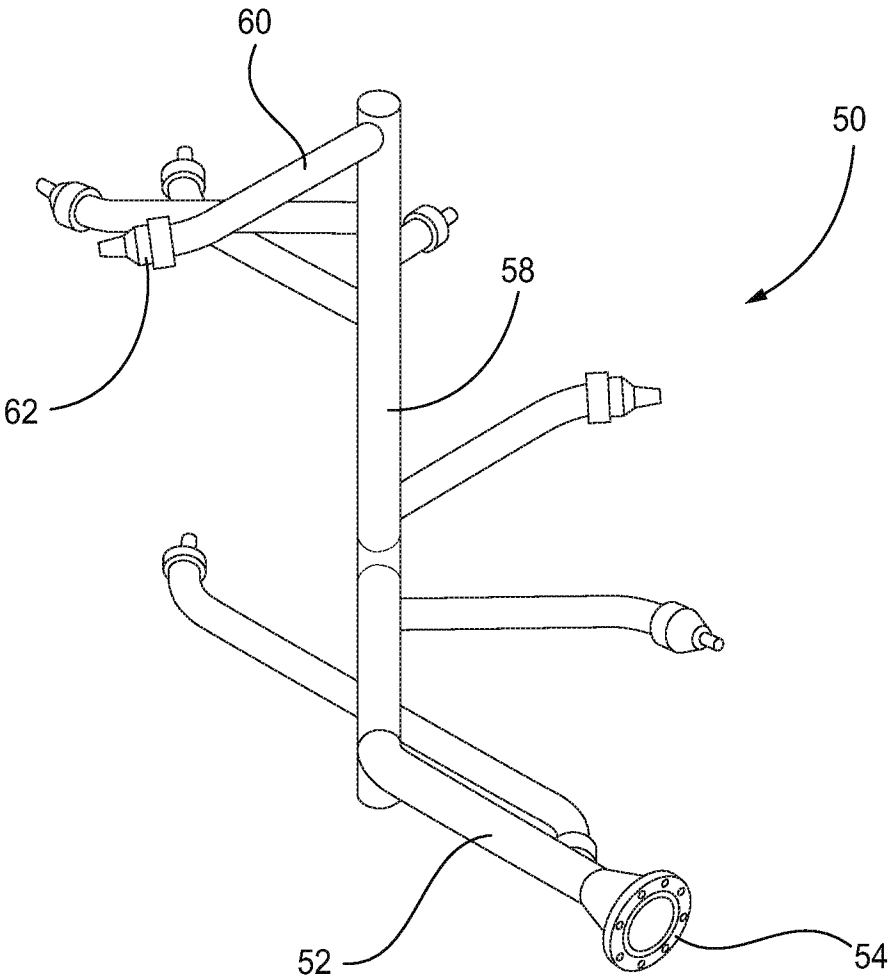
FIG. 13 is a front perspective view of the fluid circulating arrangement of FIG. 12.
Figure 15:
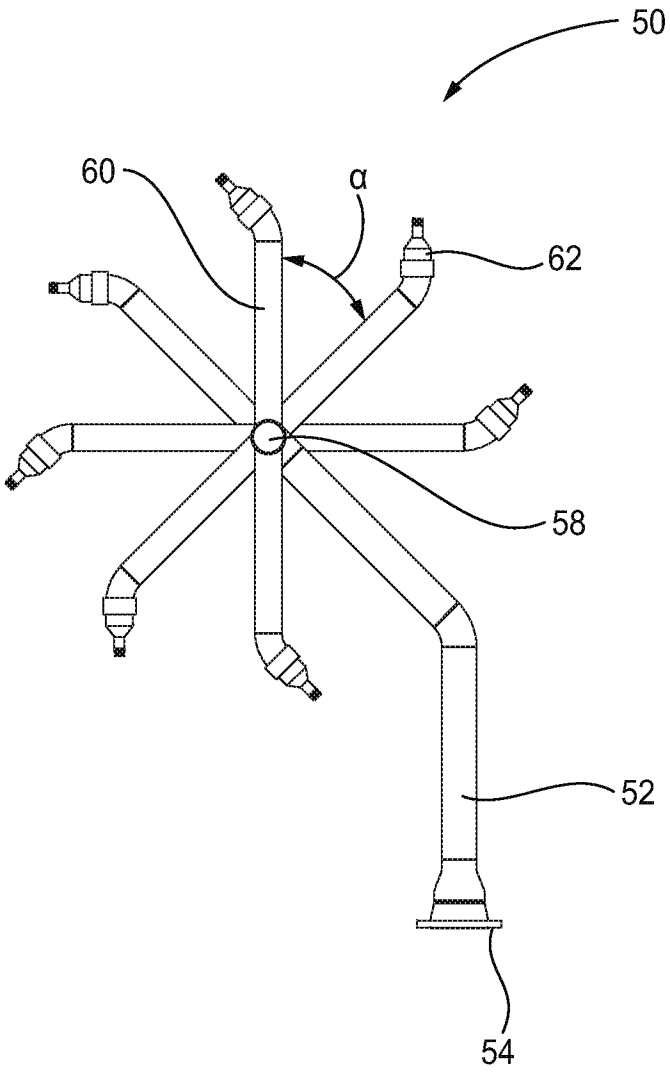
FIG. 15 is a top view of the fluid circulating arrangement of FIG. 12.
Figure 14:
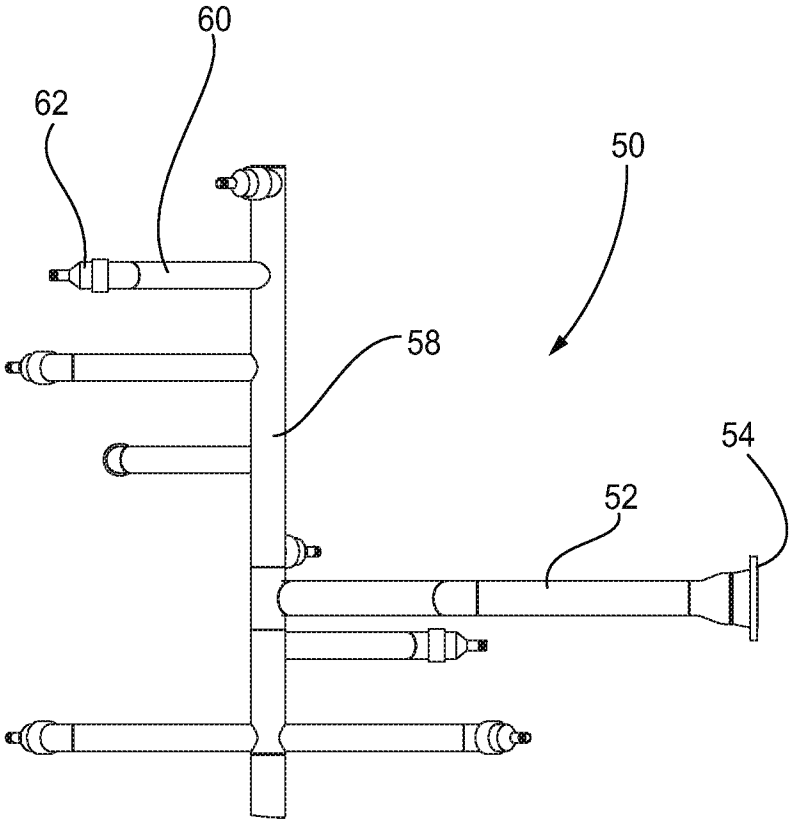
FIG. 14 is a side view of the fluid circulating arrangement of FIG. 12.

As shown in FIGS. 13-15, the discharge members 60 may be positioned at different locations around the circumferential outer surface of the main supply member 58. In this arrangement, the discharge members 60 are spaced at an angle $\alpha$ from one another. In one aspect, a first discharge member 60 may be positioned below a second discharge member 60. The second discharge member 60 may be positioned on the circumferential outer surface of the main supply member 58 at an angle $\alpha$ relative to the lower first discharge member 60. In one aspect, the angle $\alpha$ may be 45 degrees. It is also contemplated that alternative angle degrees may be used with the fluid circulating arrangement 50. It is also further contemplated that each discharge member 60 may be separated by a different angle of degree. In this manner, the discharge members 60 are positioned at an angle to one another. By providing this type of arrangement 50, the fluid stored inside of the fluid storage tank 2 may be circulated using the fluid discharged from the discharge members 60.

With continued reference to FIGS. 11-15, an external pump 64 is configured to draw fluid from the interior cavity 21 of the fluid storage tank 2 via one of the discharge valves 30*a* and return the fluid back into the fluid circulating arrangement 50 via inlet valve 56. The fluid is directed through the inlet member 52 and into the main supply member 58. Once the fluid is directed into the main supply member 58, the fluid is directed to the individual discharge members 60. Subsequently, the fluid is discharged from the nozzles 62 of the discharge members 60 to circulate the fluid stored in the fluid storage tank 2. Based on the angled arrangement of the discharge members 60, the discharged fluid may create a swirling effect within the fluid storage tank 2 so as to keep the stored fluid in constant motion. This swirling effect may cause the stored fluid to circulate in a substantially circular path around the interior cavity 21 of the body 4. By continually circulating the stored fluid, the fluid is prevented from drying out or settling, which is undesirable for situations in which the fluid is mud or slurry that is easily capable of drying out within the fluid storage tank 2.

Referring now to FIG. 16-20, an array of fluid storage tanks 2, including their corresponding frame members 10, may be fluidly connected to one another via interconnecting tubes 70 such that a hose or similar device connected to one of the discharge valves 30*a*, 30*b*, 30*c* of any fluid storage tank 2 in the array may draw fluid from all of the fluid storage tanks 2 in the array. The volume of fluid available for discharge from the array is thus limited by the number of fluid storage tanks 2 in the array, rather than by the volume of any individual fluid storage tank 2. As a result of the fluid storage tanks 2 being interconnected, a worksite operation requiring more fluid than can be stored in a single fluid storage tank 2 can be completed without switching out fluid storage tanks 2 during the operation.

Each fluid storage tank 2 in the array may include one or more connection ports 80 configured for connection to one or more interconnecting tubes 70. The connection ports 80 may be disposed at any location on the fluid storage tank 2, and each fluid storage tank 2 may include any number of connection ports 80. In the arrangement shown in FIGS. 16-18, the fluid storage tanks 2 in the array are arranged side-by-side such that their respective major axes A are generally parallel to one another and their respective minor axes B are generally aligned. This arrangement maximizes the number of fluid storage tanks 2 in a predetermined area of ground space, thus maximizing the total volume of fluid stored per unit area.

Each of the fluid storage tanks 2 includes two connection ports 80 arranged on opposite sides of the body 4 of the fluid storage tank 2 and aligned with the minor axis B of the body 4. First and second ends of each interconnecting tube 70 are attached to the connection ports 80 of two adjacent fluid storage tanks 2, thereby connecting the fluid storage tanks 2 in the array in series. This arrangement minimizes the distance between connection ports 80 of adjacent fluid storage tanks 2, thereby minimizing the necessary length of the interconnecting tubes 70.

Figure 16:
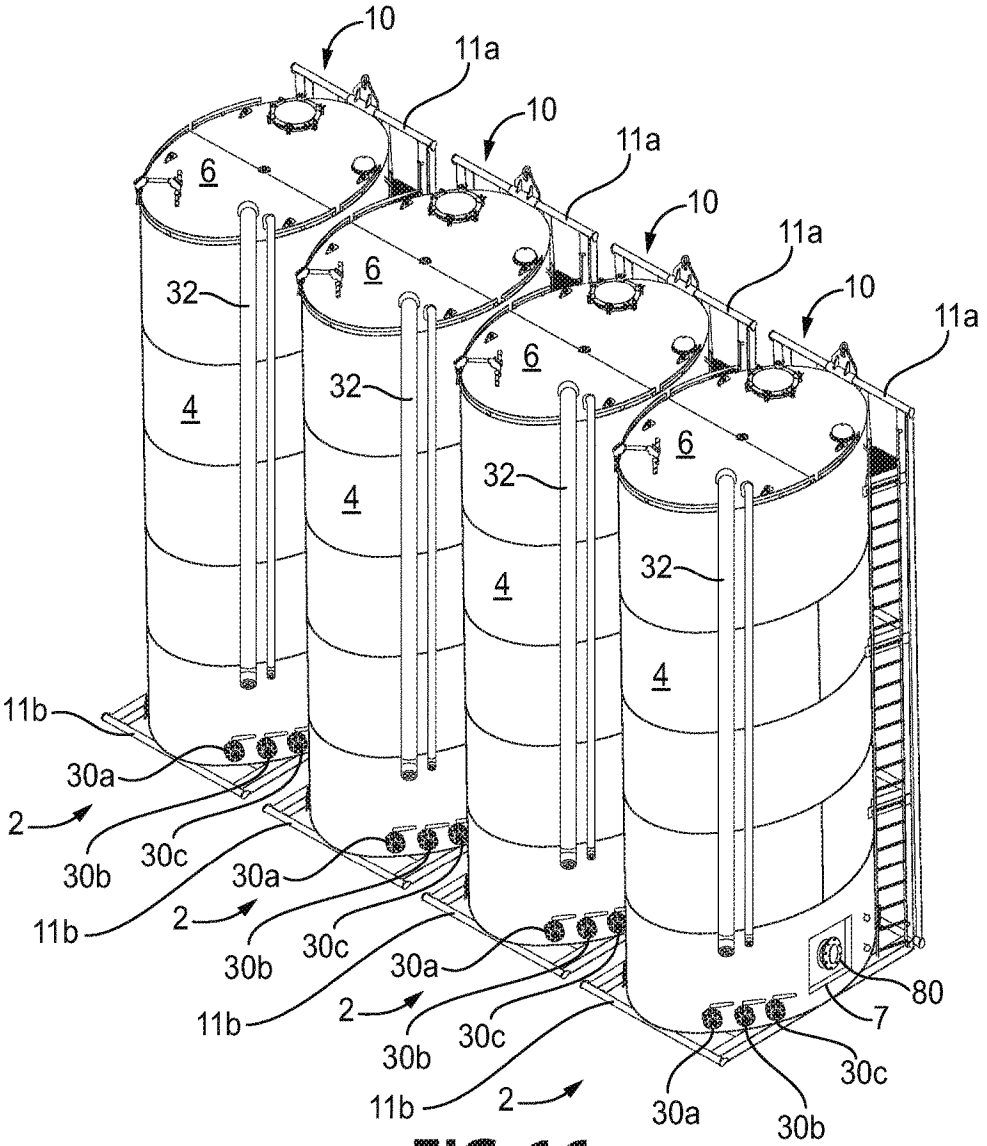
FIG. 16 is a front perspective view of an array of fluid storage tanks in accordance with another aspect of this disclosure.
Figure 17:
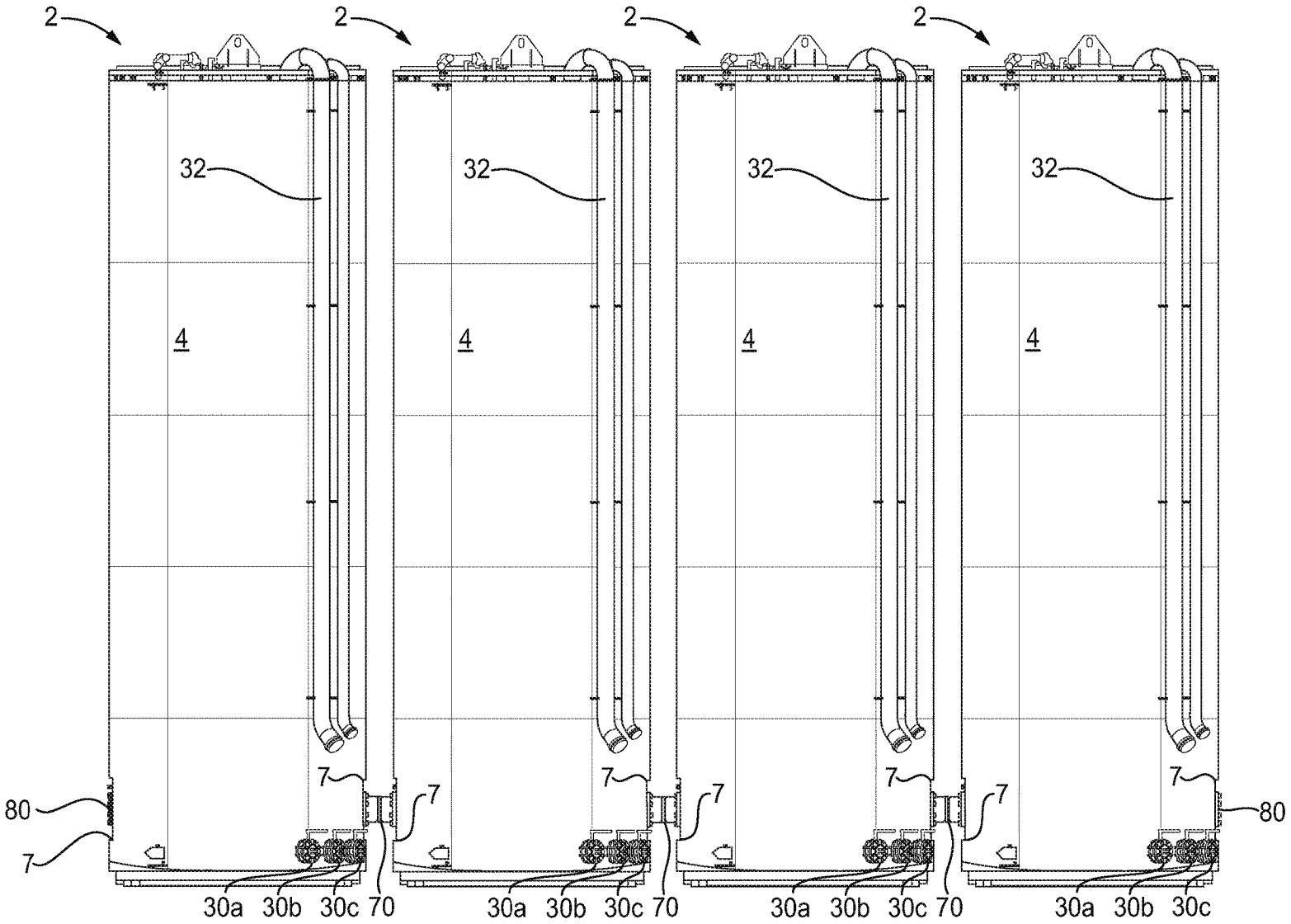
FIG. 17 is a front view of the array of fluid storage tanks of FIG. 16.
Figure 18:
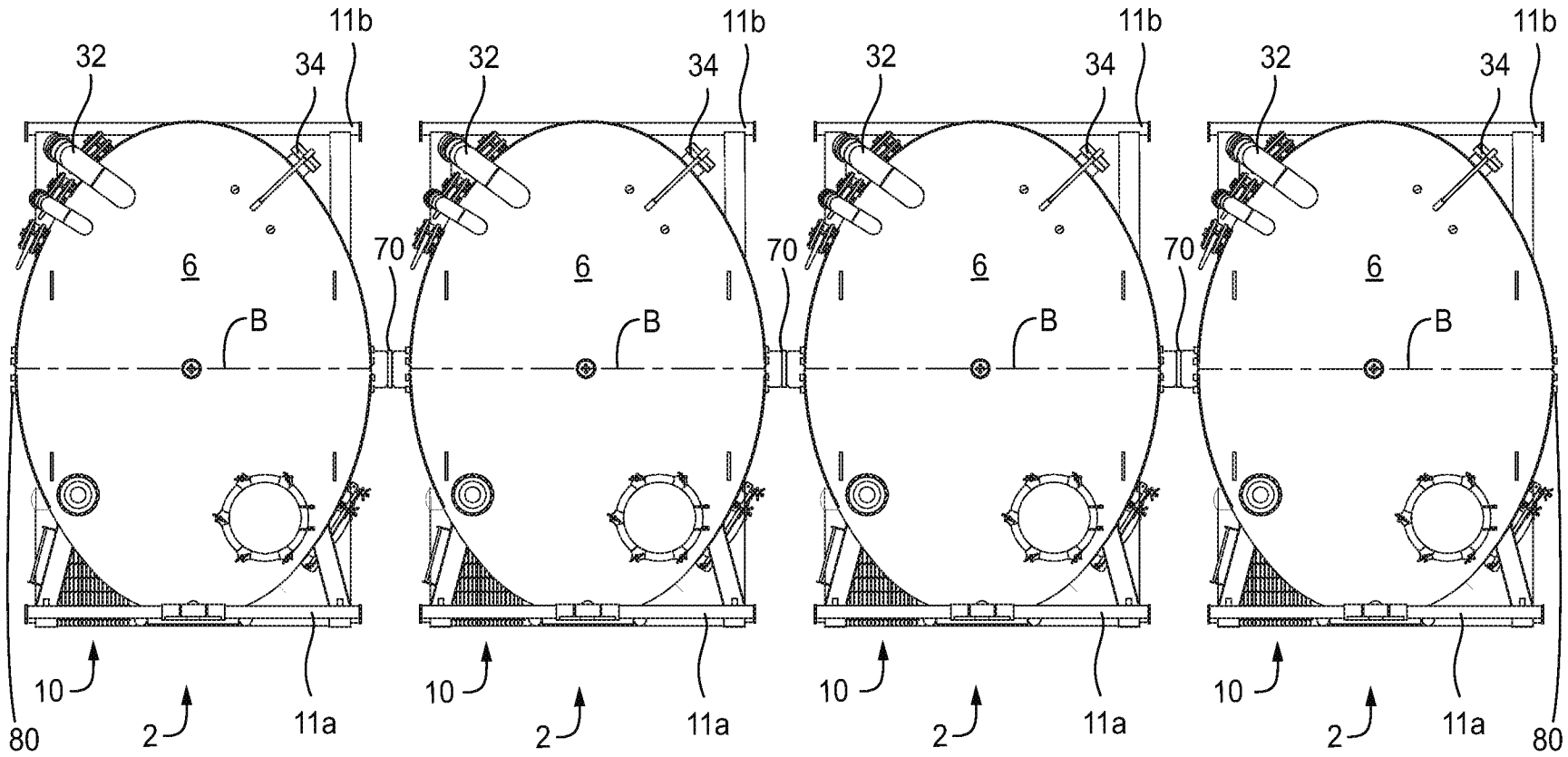
FIG. 18 is a top view of the array of fluid storage tanks of FIG. 16.

Additionally, the connection ports 80, in the arrangement shown in FIGS. 16-18, are located near the second ends 5*b* of the fluid storage tanks 2 to maximize the volume of fluid communicable between the fluid storage tanks 2 in the array. That is, the volume of fluid which is contained in a portion of each fluid storage tank 2 below the connection port 80, and which therefore cannot flow through the connection port into another fluid storage tank 2, is minimized.

Other arrangements of the fluid storage tanks 2 in the array to accommodate differing worksites will be appreciated by those skilled in the art. In some aspects, for example, the array may include multiple rows of fluid storage tanks 2, and/or the fluid storage tanks 2 may be aligned in a manner other than along their respective minor axes B. Additionally, those skilled in the art will appreciate alternative possible arrangements of the interconnecting tubes 70 and connection ports 80. For example, the interconnecting tubes 70 may be connected to the various connection ports 80 to fluidly connect the fluid storage tanks 2 in parallel arrangement, or a combination of series and parallel arrangement. In other aspects, each interconnecting tube 70 may have more than two ends for fluidly connecting more than two connection ports 80 of the fluid storage tanks 2 to one another.

Figure 19:
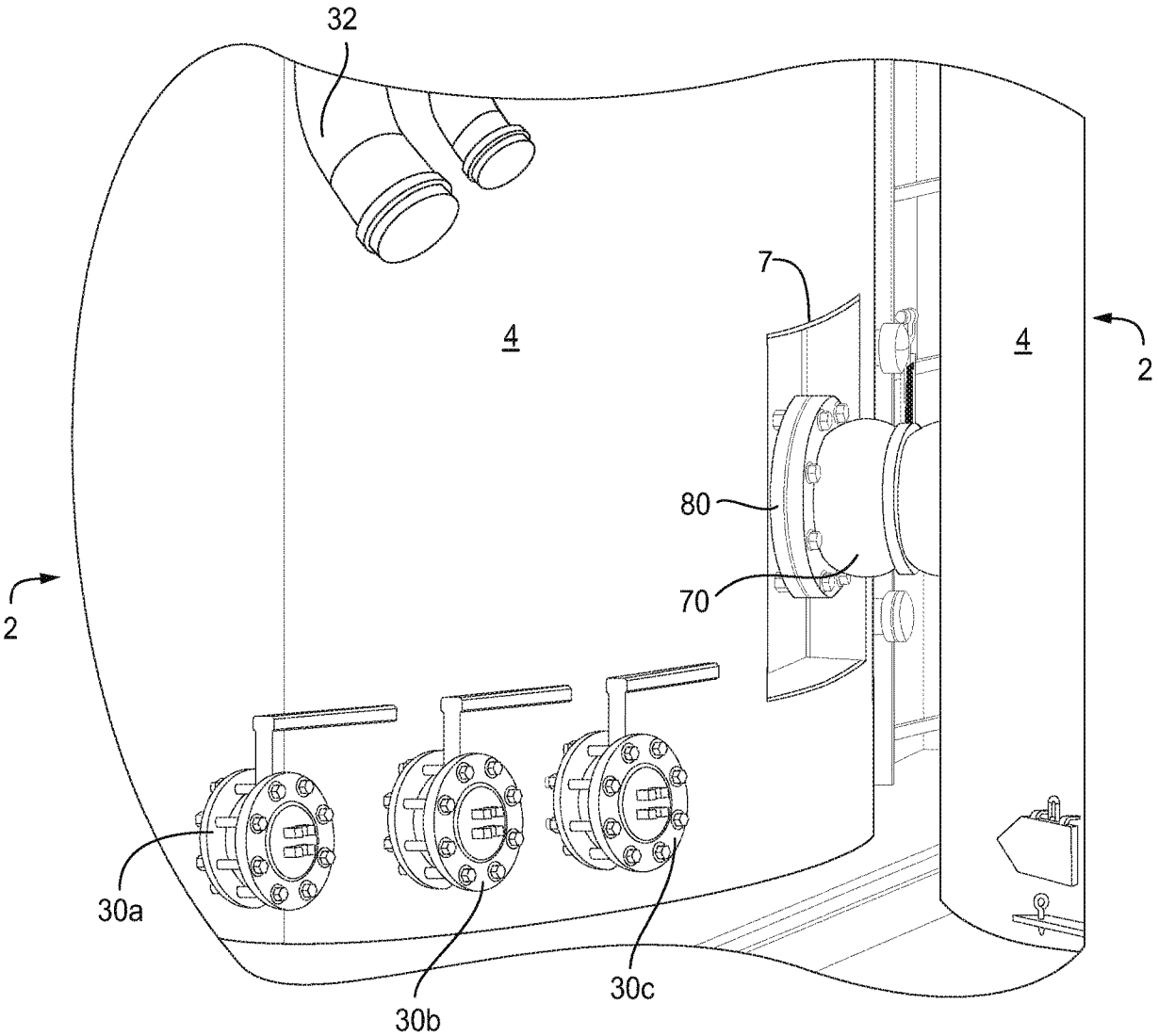
FIG. 19 is a perspective detail view of the connection between two adjacent fluid storage tanks of the array of fluid storage tanks of FIG. 16.
Figure 20:
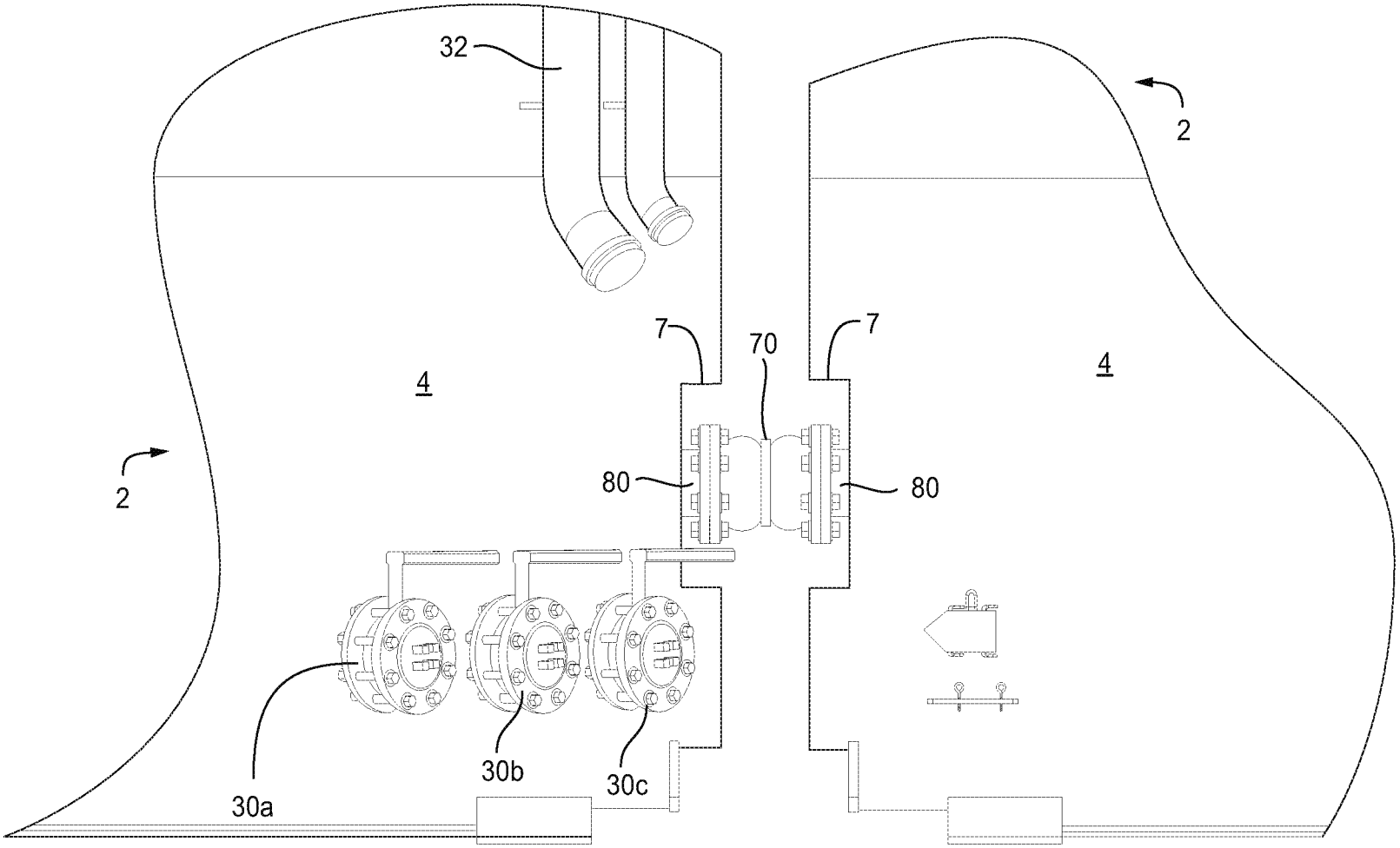
FIG. 20 is a front detail view of the connection between two adjacent fluid storage tanks of the array of fluid storage tanks of FIG. 16.

Referring now to FIGS. 19-20, each connection port 80 may be disposed in a recess 7 allowing a worker sufficient access to the connection port 80 for attaching the interconnecting tube 70 thereto. The recess 7 may be sufficiently deep such that the connection port 80 does not protrude from the perimeter of the body 4, and therefore the connection port 80 does not increase the overall dimensions of the fluid storage tank 2. As such, the overall dimensions of the fluid storage tank 2 need not be reduced to comply with size regulations promulgated by the Department of Transportation or other governing bodies.

With continuing reference to FIGS. 19-20, each interconnecting port 80 may include a flange securable via fasteners to a corresponding flange of the interconnecting tube 70 and connection ports 80. Other mechanisms for connecting the interconnecting port 80 and the interconnecting tube 70, such as fastenerless interlocks, may be appreciated by those skilled in the art. The interconnecting tube 70 may be flexible to permit misalignment in the arrangement of fluid storage tanks 2 in the array. In some aspects, the interconnection tube 70 may be used to connect fluid storage tanks 2 not arranged in an array with one another, or the interconnection tube 70 may be used to connect fluid storage tanks 2 of different arrays.

While aspects of a fluid storage tank 2 and an array of fluid storage tanks 2 are shown in the accompanying figures and described hereinabove in detail, other aspects will be apparent to, and readily made by, those skilled in the art without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A vertical fluid storage tank, comprising:

an oval-shaped body having a first end and a second end and a vertical sidewall between the first end and the second end, the oval-shaped body defining an interior fluid storage cavity, and the oval-shaped body having a major axis and a minor axis along a horizontal cross section through the oval-shaped body;

a top wall at the first end of the oval-shaped body;

a bottom wall at the second end of the oval-shaped body;

a frame member connected to the sidewall of the oval-shaped body, the frame member including a first portion that extends longitudinally along the sidewall of the oval-shaped body and a second portion that extends along the bottom wall and is connected to the first portion; and a connection port on the sidewall of the oval-shaped body adapted for connection to the connection port on an adjacent vertical fluid storage tank of identical configuration to fluidly connect the vertical fluid storage tank to the adjacent vertical fluid storage tank, wherein the connection port is located within a recess so as not to extend beyond a perimeter of the oval-shaped body, and wherein an outermost width of at least one of the first portion and the second portion is less than an outermost width of the bottom wall of the oval-shaped body.

2. The vertical fluid storage tank as claimed in claim 1, wherein an outermost width of the second portion is less than an outermost width of the bottom wall of the oval-shaped body.

3. The vertical fluid storage tank as claimed in claim 1, wherein the first portion of the frame member further comprises a ladder extending in a longitudinal direction relative to the oval-shaped body.

4. The vertical fluid storage tank as claimed in claim 1, further comprising a walkway extending across the top wall.

5. The vertical fluid storage tank as claimed in claim 1, wherein the frame member is L-shaped with the first portion extending along the longitudinal length of the oval-shaped body and the second portion extending along the bottom wall.

6. The vertical fluid storage tank as claimed in claim 1, further comprising at least one stiffening ring positioned in the interior fluid storage cavity of the oval-shaped body.

7. The vertical fluid storage tank as claimed in claim 1, further comprising at least one tension member positioned in the interior fluid storage cavity of the oval-shaped body.

8. The vertical fluid storage tank as claimed in claim 1, further comprising at least one compression member positioned in the interior fluid storage cavity of the oval-shaped body.

9. The vertical fluid storage tank as claimed in claim 1, wherein the connection port is located on the sidewall of the oval-shaped body so as to be aligned with the minor axis.

10. The vertical fluid storage tank as claimed in claim 1, further comprising a pair of connection ports located on opposite sides of the oval-shaped body, wherein each of the connection ports is aligned with the minor axis.

11. An array of vertical fluid storage tanks, comprising:

a plurality of vertical fluid storage tanks located side-by-side to one another, each vertical fluid storage tank comprising:

an oval-shaped body having a first end and a second end and a vertical sidewall between the first end and the second end, the oval-shaped body defining an interior fluid storage cavity, and the oval-shaped body having a major axis and a minor axis along a horizontal cross section through the oval-shaped body;

a top wall at the first end of the oval-shaped body;

a bottom wall at the second end of the oval-shaped body;

a frame member connected to the sidewall of the oval-shaped body, the frame member including a first portion that extends longitudinally along the sidewall of the oval-shaped body and a second portion that extends along the bottom wall and is connected to the first portion; and a connection port on the sidewall of the oval-shaped body connected to the connection port of an adjacent vertical fluid storage tank in the array to fluidly connect the vertical fluid storage tank to the adjacent vertical fluid storage tank, and wherein, in the array, each of the adjacent vertical fluid storage tanks is arranged such that the major axes of the respective vertical fluid storage tanks are parallel to one another and wherein an outermost width of at least one of the first portion and the second portion is less than an outermost width of the bottom wall of the oval-shaped body.

12. The array of vertical fluid storage tanks as claimed in claim 11, wherein an outermost width of the second portion of the frame member of at least one of the vertical fluid storage tanks is less than an outermost width of the bottom wall of the oval-shaped body.

13. The array of vertical fluid storage tanks as claimed in claim 11, wherein the first portion of the frame member of at least one of the vertical fluid storage tanks further comprises a ladder extending in a longitudinal direction relative to the oval-shaped body.

14. The array of vertical fluid storage tanks as claimed in claim 11, wherein at least one of the vertical fluid storage tanks further comprises a walkway extending across the top wall.

15. The array of vertical fluid storage tanks as claimed in claim 11, wherein the frame member of each vertical fluid storage tank is L-shaped with the first portion extending along the longitudinal length of the oval-shaped body and the second portion extending along the bottom wall.

16. The array of vertical fluid storage tanks as claimed in claim 11, wherein at least one of the vertical fluid storage tanks further comprises at least one stiffening ring positioned in the interior fluid storage cavity of the oval-shaped body.

17. The array of vertical fluid storage tanks as claimed in claim 11, wherein at least one of the vertical fluid storage tanks further comprises at least one tension member positioned in the interior fluid storage cavity of the oval-shaped body.

18. The array of vertical fluid storage tanks as claimed in claim 11, wherein at least one of the vertical fluid storage tanks further comprises at least one compression member positioned in the interior fluid storage cavity of the oval-shaped body.

19. The array of vertical fluid storage tanks as claimed in claim 11, wherein the connection port on each of the vertical fluid storage tanks is located on the sidewall of the oval-shaped body so as to be aligned with the minor axis.

20. The array of vertical fluid storage tanks as claimed in claim 11, wherein each vertical fluid storage tank further comprises a pair of connection ports located on opposite sides of the oval-shaped body, and wherein each of the connection ports is aligned with the minor axis of the respective vertical fluid storage tanks.

* * * * *